US006446590B1

(12) United States Patent
Kinugawa

(10) Patent No.: US 6,446,590 B1
(45) Date of Patent: Sep. 10, 2002

(54) VALVE TIMING CONTROL DEVICE

(75) Inventor: Hiroyuki Kinugawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/981,259

(22) Filed: Oct. 18, 2001

(30) Foreign Application Priority Data

Mar. 19, 2001 (JP) ..... 2001-079022

(51) Int. Cl.[7] ..... F01L 1/34
(52) U.S. Cl. ..... 123/90.17; 123/90.37
(58) Field of Search ..... 123/90.15, 90.17, 123/90.31, 90.37; 74/568 R; 464/1, 2, 160

(56) References Cited

U.S. PATENT DOCUMENTS 5,823,152 A * 10/1998 Ushida ..... 123/90.17
6,302,072 B1 * 10/2001 Sekiya et al. ..... 123/90.17
6,334,414 B1 * 1/2002 Okada et al. ..... 123/90.15

FOREIGN PATENT DOCUMENTS

JP 10-159515 6/1998

* cited by examiner

*Primary Examiner*—Weilun Lo

(74) *Attorney, Agent, or Firm*—Sughrue Mion, PLLC

(57) ABSTRACT

A valve timing control device includes a first rotor, a second rotor, a fitting hole, a tier control member, an accommodation hole, a first release hydraulic pressure chamber and a second release hydraulic pressure chamber. The first rotor rotates in synchronization with a crankshaft of an internal combustion engine and has a plurality of shoes, which are projected inwardly to define a plurality of hydraulic pressure chambers. The second rotor is fixed at an end of a camshaft of the internal combustion engine and has a plurality of vanes which partition the plural hydraulic pressure chambers of the first rotor into an advance side hydraulic pressure chamber and a retardation side hydraulic pressure chamber. The fitting hole is disposed at any one of the first rotor or the second rotor. The tier control member fits in the fitting hole to control a relative rotation of the first and second rotors and having a front minor diameter section and a rear major diameter section. The accommodation hole disposed at the other to accommodate the tier control member. The biasing member biases the tier control member in a direction of fitting the tier control member in the fitting hole. The first release hydraulic pressure chamber is defined between the front minor diameter section of the tier control member and the fitting hole. The second release hydraulic pressure chamber is defined between an end face of the rear major diameter section of the tier control member in an axial direction of the device and the accommodation hole. At least one of the advance and retardation side hydraulic pressure chambers communicates with both the first and second release hydraulic pressure chambers.

8 Claims, 14 Drawing Sheets

VALVE TIMING CONTROL DEVICE

BACKGROUND OF THE INVENTION

1. Field of the Invention

The present invention relates to a valve timing control device, which modifies an open/close timing of an intake valve or an exhaust valve of an internal combustion engine (hereafter, referred as an engine).

2. Description of the Prior Art

Different kinds of devices are known as the conventional valve timing control devices (hereafter, referred as a VVT). FIG. 1 is a lateral cross sectional view showing an internal construction of the conventional VVT disclosed in JP-A-1998/159515. FIG. 2 is a longitudinal cross sectional view taken along lines A1—A1 of FIG. 1. FIG. 3 is an enlarged cross sectional view taken along lines A2—A2 of FIG. 1, showing a tier control member locking a free rotation of two rotational members. FIG. 4A is an enlarged cross sectional view taken along lines A2—A2 of FIG. 1, showing the tier control member releasing the lock of the free rotation due to a release hydraulic pressure supplied from an advance side hydraulic pressure chamber. FIG. 4B is a plane view showing an area of a force-exerted face of the tier control member shown in FIG. 4A. FIG. 5A is an enlarged cross sectional view taken along lines A2—A2 of FIG. 1, showing the tier control member releasing the lock of the free rotation due to a release hydraulic pressure supplied from a retardation side hydraulic pressure chamber. FIG. 5B is a plane view showing an area of a force-exerted face of the tier control member in FIG. 5A.

In the drawings, reference numeral 1 denotes a housing (first rotor) provided integrally a chain sprocket section 1*a* on which a rotational driving force of a crankshaft (not shown) of the engine. Numeral 2 denotes a case (first rotor) having a plurality of shoes 2*a*, 2*b*, 2*c* and 2*d*, which is located at the housing 1, and which is projected inwardly to form a plurality of hydraulic pressure chambers. Numeral 3 denotes a rotor (second rotor) including a boss section 3*a* located at a central part of the rotor 3 and a plurality of vanes 3*b*, 3*c*, 3*d* and 3*e* formed at an outer peripheral surface of the boss section 3*a*. The boss section 3*a* is fixed at an end of a camshaft (not shown) with a bolt (not shown). The vanes 3*b*, 3*c*, 3*d* and 3*e* partition the plural hydraulic pressure chambers into advance side hydraulic pressure chambers 4 and retardation side hydraulic pressure chambers 5. The advance side hydraulic pressure chamber 4 moves rotationally the second rotor with respect to the first rotor toward the advance side when a hydraulic pressure is supplied from an oil pump (not shown) of the engine via an oil control valve (not shown and hereafter referred as OCV). The retardation side hydraulic pressure chamber 5 moves rotationally the second rotor with respect to the first rotor toward the retardation side when the hydraulic pressure is supplied from the oil pun (not shown) via the OCV. A direction, which is indicated by arrow X1 in FIG. 1, incidentally means a rotational direction of the camshaft (not shown).

Seal members 6 are disposed at ends of the shoes 2*a*, 2*b*, 2*c* and 2*d* of the case 2 and at ends of the vanes 3*b*, 3*c*, 3*d* and 3*e* of the rotor 3, respectively. The seal member 6 creates a seal to block flow of actuating oil between the advance side hydraulic pressure chamber 4 and the retardation side hydraulic pressure chamber 5 to keep a hydraulic pressure in the respective hydraulic pressure chambers 4 and 5. The seal member 6 includes a resilient seal 6*a* made of resin, and a leaf spring 6*b*, which biases the seal 6*a* against a seal-facing surface. The seal-facing surface means the outer region of the rotor 3 when the seal 6 is disposed at the case 2, and means an inner region of the case 2 when the seal 6 is disposed at the rotor 3, for example.

Numeral 7 denotes a cover (first rotor) closing an end of the rotor 3, which opposes to the housing 1. The cover 7 is integrally fixed at the housing 1 with a threaded bolt 8 passing through the shoes 2*a*, 2*b*, 2*c* and 2*d* of the case 2. The housing 1, the case 2 and the cover 7 constitutes the first rotor rotating in synchronization with the crankshaft (not shown).

A locative relationship between the first and second rotors is kept due to the adequate hydraulic pressure supplied to the advance side hydraulic pressure chamber 4 or the retardation side hydraulic pressure chamber 5 when the engine is usually operated. However, when the engine is stopped and a hydraulic pressure in the VVT is returned to an oil pan (not shown), the locative relationship between the first and second rotors is not kept due to the hydraulic pressure. Here, a beat noise (abnormal noise) results when the first rotor comes into contact with and separates from the second rotor over and over again as the engine is restarted. A lock pin (tier control member) 9 is arranged at the VVT in order to prevent the occurrence of the beat noise. The lock pin 9 locks a relative rotation of the first and second rotors when the engine is stopped or restarted, and allows the relative rotation when the engine is usually operated.

The lock pin 9 includes a front minor diameter section 9*a*, a central flange section 9*b*, a rear major diameter section 9*c* and a hollow section 9*d* as shown in FIG. 2 to FIG. 5B. The central flange section 9*b* has a diameter being larger than the front minor diameter section 9*a*, the rear major diameter section 9*c* has a diameter being larger than the central flange section 9*b*. The hollow section 9*d* is formed at a central portion of a bottom of the rear major diameter section 9*c*. The lock pin 9 is enclosed in an accommodation hole 10, which is formed at the vane 3*b* of the rotor 3 in an axial direction (directions indicated by arrows Y1 and Y2) of the VVT. A cylindrical holder 11 is press-fitted in the accommodation hole 10 before accommodating the lock pin 9. The holder 11 includes a minor diameter section 11*a*, a major diameter section 11*b* and a tier section 11*c* defined as a boundary between the minor and major diameter sections 11*a* and 11*b*. The minor diameter section 11*a* has an inner diameter corresponding to the outer diameter of central flange section 9*b* of the lock pin 9. The major diameter section 11*b* has an inner diameter corresponding to the outer diameter of the rear major diameter section 9*c* of the lock pin 9. A coil spring (biasing member) 12 is arranged between the bottom of the accommodation hole 10 and the hollow section 9*d* of the lock pin 9, and biases the lock pin 9 toward the housing 1 at all times. On the other hand, a fitting hole 13 is disposed at an end of the housing 1 facing to the rotor in the axial direction of the VVT, and allows fitting of the front minor diameter section 9*a* of the lock pin 9. A first release hydraulic pressure chamber 14 is defined between the fitting hole 13 and the front minor diameter section 9*a* of the lock pin 9, and communicates with the advance side hydraulic pressure chamber 4 at all times. The first release hydraulic pressure chamber 4 does not communicate with the retardation side hydraulic pressure chamber 5 due to the seal member 6. A second release hydraulic pressure chamber 16 is defined between the rear major diameter section 9*c* of the lock pin 9 and the minor diameter 11*a* of the holder 11 within the accommodation hole 10. The second release hydraulic pressure chamber 16 communicates with only the retardation side hydraulic pressure chamber 5 at all times via a retardation side communication passage 15.

When the lock pin 9 moves backward due to the release hydraulic pressure, a rear space of the lock pin 9 defined in the accommodation hole 10 functions as a backward pressure chamber. A discharge hole 17 is formed at a rear portion of the accommodation hole 10 as shown in FIG. 2, and discharges the backward pressure to the outside of the VVT. A first oil passage 18 is disposed at the advance side hydraulic pressure chamber 4, and supplies a hydraulic pressure from the OCV (not shown) to the advance side hydraulic pressure chamber 4. A second oil passage 19 is disposed at the retardation side hydraulic pressure chamber 5, and supplies a hydraulic pressure from the OCV (not shown) to the retardation side hydraulic pressure chamber 5.

An operation will be hereafter explained.

When the engine is stopped, oil of the VVT returns to the oil pan (not shown). As shown in FIG. 3, the release hydraulic pressure is not supplied to any of the first release hydraulic pressure chamber 14 and the second release hydraulic pressure chamber 16. The lock pin 9 therefore moves forward (upward of FIG. 3) due to a biasing force of the coil spring 12, and then the front minor diameter section 9*a* of the lock pin 9 fits in the fitting hole 13. In this way, the relative rotation of the first and second rotors is locked.

The hydraulic pressure of the advance side hydraulic pressure chamber 4 or the retardation side hydraulic pressure chamber 5 is used as the release hydraulic pressure when the engine is usually operated. First, the hydraulic pressure of the advance side hydraulic pressure chamber 4 is used as the release hydraulic pressure. Here, oil is supplied from the oil pump (not shown) to the advance side hydraulic pressure chamber 4 via the OCV (not shown) and the first oil passage 18. The hydraulic pressure of the advance side hydraulic pressure chamber 4 is supplied to the first release hydraulic pressure chamber 14 via a passage defined at the end of the rotor 3 facing to the housing 1 as indicated by arrow of FIG. 4A. The release hydraulic pressure exerts on both ends of the front minor diameter section 9*a* and the central flange section 9*b* of the lock pin 9. The lock pin 9 therefore moves backward the accommodation hole 10 as shown in FIG. 4B. The front minor diameter section 9*a* of the lock pin 9 is finally disconnected from the accommodation hole 10 to allow the relative rotation of the first and second rotors.

The hydraulic pressure of the retardation side hydraulic pressure chamber 5 is used as the release hydraulic pressure. Here, oil is supplied from the oil pump (not shown) to the retardation side hydraulic pressure chamber 5 via the OCV (not shown) and the second oil passage 19. The hydraulic pressure of the retardation side hydraulic pressure chamber 5 is supplied to the second release hydraulic pressure chamber 16 via the retardation side communication passage 15 as indicated by arrow of FIG. 5A. The release hydraulic pressure exerts on the end of the rear major diameter section 9*c* of the lock pin 9. The lock pin 9 therefore moves backward the accommodation hole 10 as shown in FIG. 5B. The front minor diameter section 9*a* of the lock pin 9 is finally disconnected from the accommodation hole 10 to allow the relative rotation of the first and second rotors.

The constitution of the conventional VVT above reduces the force-exerted face of the lock pin 9 by half in the two cases of using the release hydraulic pressure of the advance side and using the release hydraulic pressure of the retardation side. In any of these cases, the area of force-exerted face of the lock pin 9 becomes small. It is therefore necessary to set a small biasing force of the coil spring 12 allowing the release due to a small release hydraulic pressure, which exerts on a small area of force-exerted face above. Here, the biasing force of the coil spring 12 and the release hydraulic pressure are both small, and the lock/release operation is therefore susceptible to a sliding resistance of the lock pin 9. When the lock pin 9 is upsized, the sliding resistance can have little effect on the lock/release operation, because the biasing force of coil spring and release hydraulic pressure become both large. The upsizing of the lock pin 9 results in the upsizing of the VVT itself. This runs counter to a downsizing in demand for the VVT in recent years.

The lock pin 9 itself of the conventional VVT is downsized and the biasing force of the coil spring 12 lets it go. In this case, the area of force-exerted face of the lock pin 9 subject to the release hydraulic pressure supplied from the advance side hydraulic pressure chamber 4 becomes small in proportional to the square of the radius of the lock pin 9. The release hydraulic pressure supplied from the advance side hydraulic pressure chamber 4 becomes weak in comparison to the biasing force of the coil spring 12. In this way, the lock pin 9 is resistant to disconnect from the fitting hole 13 when the second rotor locates at an advance side with respect to the first rotor, and the operation of the VVT becomes unstable.

SUMMARY OF THE INVENTION

Accordingly, it is an object of the present invention to provide a valve timing control device having the enlarged force-exerted face of the tier control member to ensure the high stability of operation.

In order to achieve the object of the present invention, a valve timing control device comprises a first rotor rotating in synchronization with a crankshaft of an internal combustion engine and having a plurality of shoes which are projected inwardly to define a plurality of hydraulic pressure chambers; a second rotor fixed at an end of a camshaft of the internal combustion engine and having a plurality of vanes which partition the plural hydraulic pressure chambers of the first rotor into an advance side hydraulic pressure chamber and a retardation side hydraulic pressure chamber; a fitting hole disposed at any one of the first rotor or the second rotor; a tier control member fitting in the fitting hole to control a relative rotation of the first and second rotors and having a front minor diameter section and a rear major diameter section; an accommodation hole disposed at the other to accommodate the tier control member; a biasing member biasing the tier control member in a direction of fitting the tier control member in the fitting hole; a first release hydraulic pressure chamber defined between the front minor diameter section of the tier control member and the fitting hole; and a second release hydraulic pressure chamber defined between an end face of the rear major diameter section of the tier control member in an axial direction of the device and the accommodation hole, wherein at least one of the first and second release hydraulic pressure chambers communicates with both the advance and retardation side hydraulic pressure chambers. In this way, an area of a force-exerted face of the tier control member can become large, and a biasing force of the biasing member and a release hydraulic pressure both can be large. A lock/release operation of the tier control member can be therefore performed with reliability to ensure the high stability of operation. Even if the tier control member is downsized without changing the biasing force of the biasing member, the area of force-exerted face of the tier control member can become large. It can ensure the high stability of operation without effect of the sliding resistance generated between the tier control member and the accommodation hole.

The first release hydraulic pressure chamber or the second release hydraulic pressure chamber may communicate with the advance side hydraulic pressure chamber at all times. In this way, when a hydraulic pressure of the advance side hydraulic pressure chamber is applied, the advance side hydraulic pressure chamber communicates with the release hydraulic pressure chamber, which does not communicate with the advance side hydraulic pressure chamber in ordinary cases. The release hydraulic pressure supplied from the advance side hydraulic pressure chamber can be easily supplied to both of the first and second release hydraulic pressure chambers, and the area of force-exerted face of the tier control member can be increased to ensure the high stability of operation.

It may further comprise a check valve supplying the higher hydraulic pressure of the advance and retardation side hydraulic pressure chambers to the tier control member as a release hydraulic pressure for releasing the lock of the tier control member, and at least one of the first and second release hydraulic pressure chambers may communicate with both the advance and retardation side hydraulic pressure chambers via the check valve. In this way, the check valve facilitates supplying the release hydraulic pressure supplied from the advance or retardation side hydraulic pressure chamber to both of the first and second release hydraulic pressure chambers. The area of force-exerted face of the tier control member can be increased to ensure the high stability of operation.

A force-exerted face of the tier control member accommodated in the second release hydraulic pressure chamber to which the release hydraulic pressure is supplied via the check valve may be a ring-shaped section defined at the end face of the rear major diameter section in the axial direction of the device. In this way, the release hydraulic pressure supplied from the advance or retardation side hydraulic pressure chamber can be subject to the tier control member with reliability to ensure the high stability of operation.

A force-exerted face of the tier control member accommodated in the first release hydraulic pressure chamber to which the release hydraulic pressure is supplied via the check valve may be a circular section of the front minor diameter section. In this way, the release hydraulic pressure supplied from the advance or retardation side hydraulic pressure chamber can be subject to the tier control member with reliability to ensure the high stability of operation.

An area of a force-exerted face of the tier control member, which is subject to a hydraulic pressure of the advance side hydraulic pressure chamber may be equal to or larger than an area of a force-exerted face of the tier control member, which is subject to a hydraulic pressure of the retardation side hydraulic pressure chamber. In this way, even if the release hydraulic pressure supplied from the advance side hydraulic pressure chamber is nearly equal to the release hydraulic pressure supplied from the retardation side hydraulic pressure, the lock of the tier control member can be reliably released against the biasing force of the biasing member.

It can therefore ensure the high stability of operation. Even if the lock of the tier control member is not quite released on application of the hydraulic pressure supplied from the retardation side hydraulic pressure chamber, a time for moving the tier control member back can be shortened on application of the hydraulic pressure supplied from the advance side hydraulic pressure chamber. When the relative rotation of the first and second rotors is started, the lock of the tier control member can be released in good timing.

It may further comprise a seal member arranged between the fitting hole and the retardation side hydraulic pressure chamber and creating a seal to block flow of actuating oil between the advance and retardation side hydraulic pressure chambers. In this way, the advance side hydraulic pressure chamber can communicate with both of the first and second release hydraulic pressure chambers, and the area of force-exerted face of the tier control member can therefore become large on application of the hydraulic pressure supplied from the advance side hydraulic pressure chamber. A biasing force of the biasing member and a release hydraulic pressure both can be large. A lock/release operation of the tier control member can be therefore performed with reliability to ensure the high stability of operation. Even if the tier control member is downsized without changing the biasing force of the biasing member, the area of force-exerted face of the tier control member can become large. It can ensure the high stability of operation without effect of the sliding resistance generated between the tier control member and the accommodation hole.

The fitting hole may be disposed at an approximately intermediate position apart from any of the maximum advanced side position and the maximum retarded side position, and a seal member may be arranged between the fitting hole and the retardation side hydraulic pressure chamber and creating a seal to block flow of actuating oil between the advance and retardation side hydraulic pressure chambers. In this way, the type of VVT locking the first and second rotors at the approximately intermediate position has the same effect as the other type of VVT. In brief, the advance side hydraulic pressure chamber can communicate with both of the first and second release hydraulic pressure chambers, and the area of force-exerted face of the tier control member can therefore become large on application of the hydraulic pressure supplied from the advance side hydraulic pressure chamber. A biasing force of the biasing member and a release hydraulic pressure both can be large. A lock/release operation of the tier control member can be therefore performed with reliability to ensure the high stability of operation.

DESCRIPTION OF THE PREFERRED EMBODIMENT OF THE INVENTION

Embodiments of the present invention will be hereafter explained.

Embodiment 1

Figure 1:
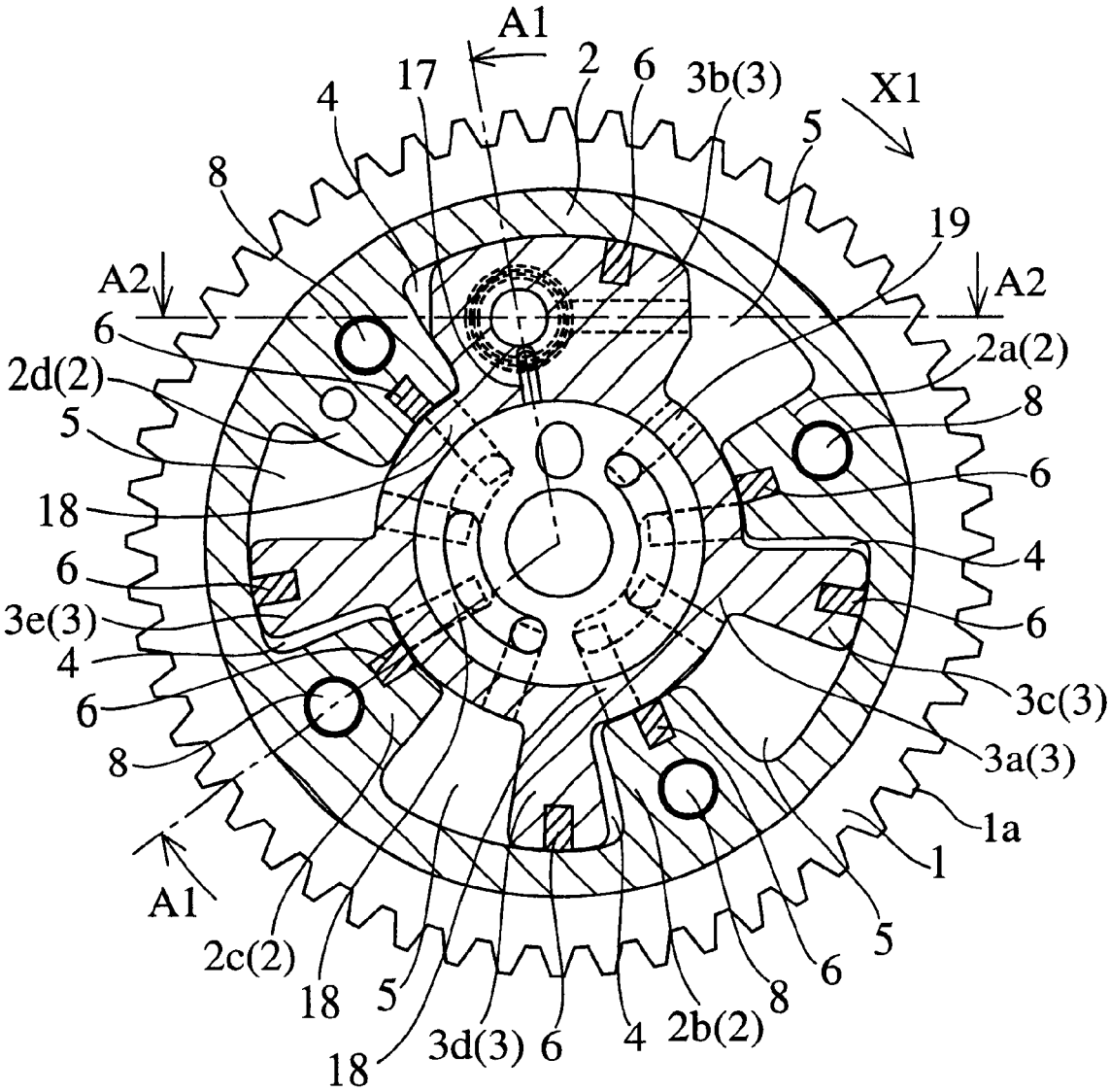
FIG. 1 (PRIOR ART)
FIG. 1 is a lateral cross sectional view showing an internal construction of the conventional VVT.
Figure 2:
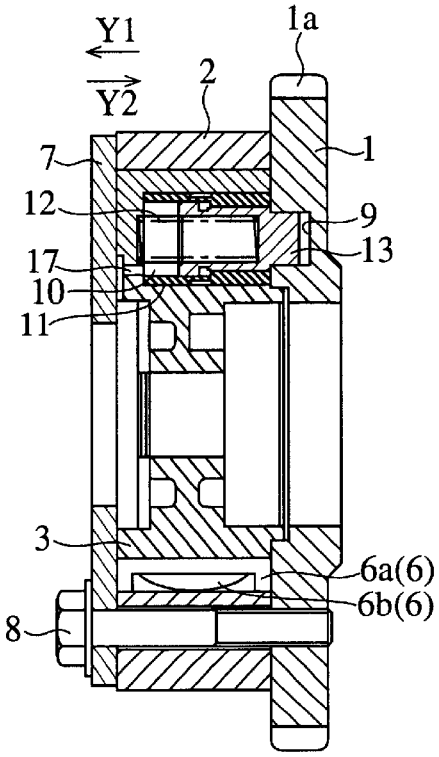
FIG.2 (PRIOR ART)
FIG. 2 is a longitudinal cross sectional view taken. along lines A1—A1 of FIG. 1.
Figure 3:
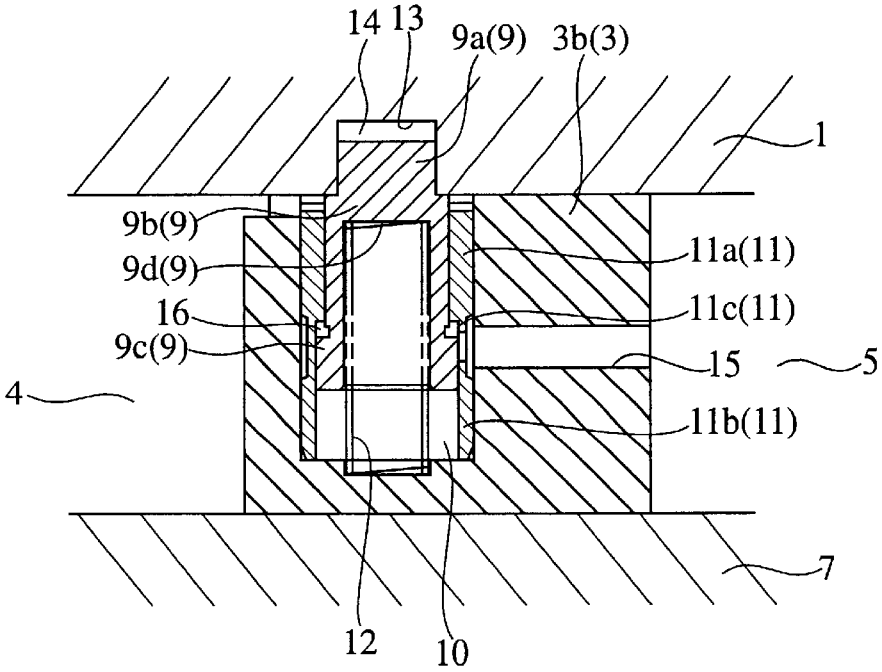
FIG.3 (PRIOR ART)
FIG. 3 is an enlarged cross sectional view taken along lines A2—A2 of FIG. 1, showing a tier control member locking a free rotation of two rotational members.
Figure 4A:
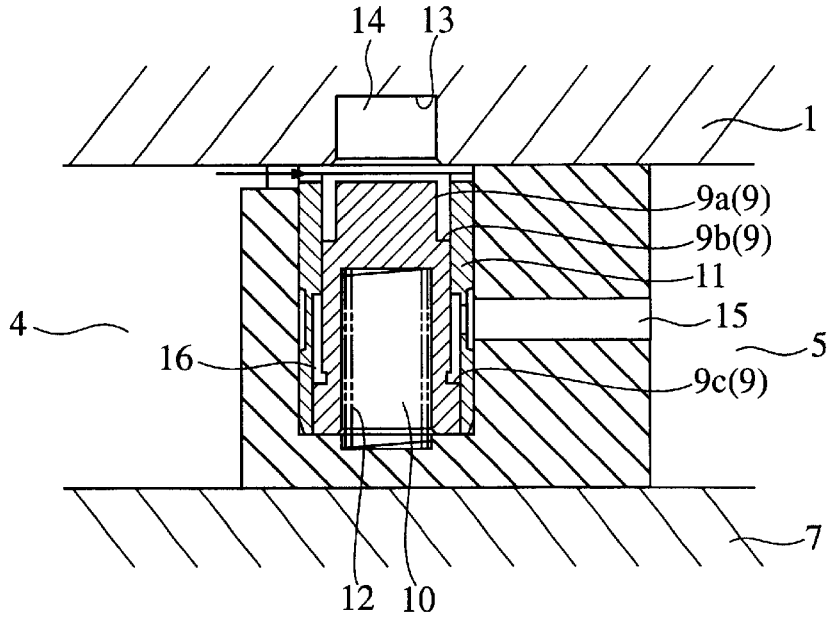
FIG.4A (PRIOR ART)
FIG. 4A is an enlarged cross sectional view taken along lines A2—A2 of FIG. 1, showing the tier control member releasing the lock of the free rotation due to a release hydraulic pressure supplied from an advance side hydraulic pressure chamber.
Figure 4B:
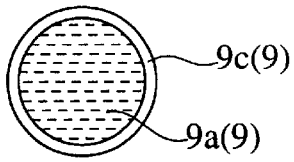
FIG.4B (PRIOR ART)
FIG. 4B is a plane view showing an area of a force-exerted face of the tier control member shown in FIG. 4A.
Figure 5A:
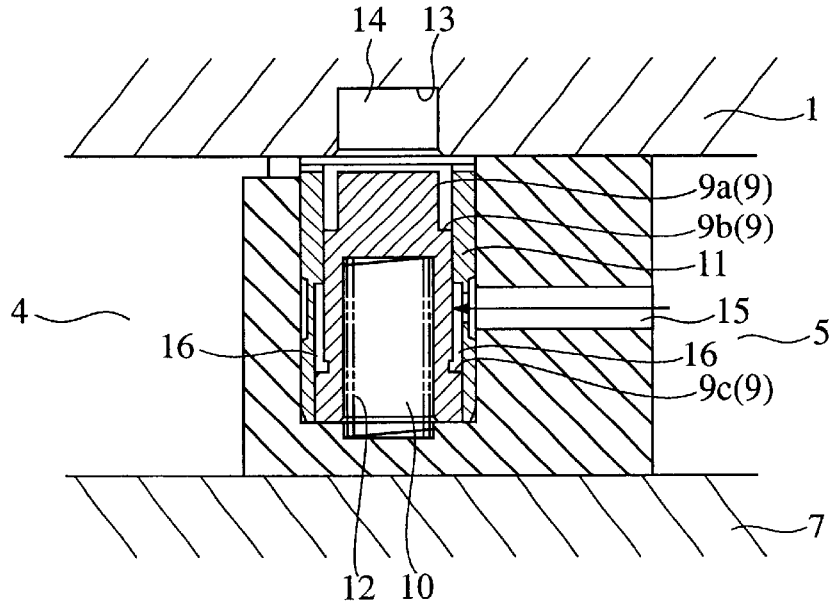
FIG.5A (PRIOR ART)
FIG. 5A is an enlarged cross sectional view taken along lines A2—A2 of FIG. 1, showing the tier control member releasing the lock of the free rotation due to a release hydraulic pressure supplied from a retardation side hydraulic pressure chamber.
Figure 5B:
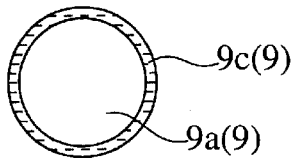
FIG.5B (PRIOR ART)
FIG. 5B is a plane view showing an area of a force-exerted face of the tier control member in FIG. 5A.
Figure 6:
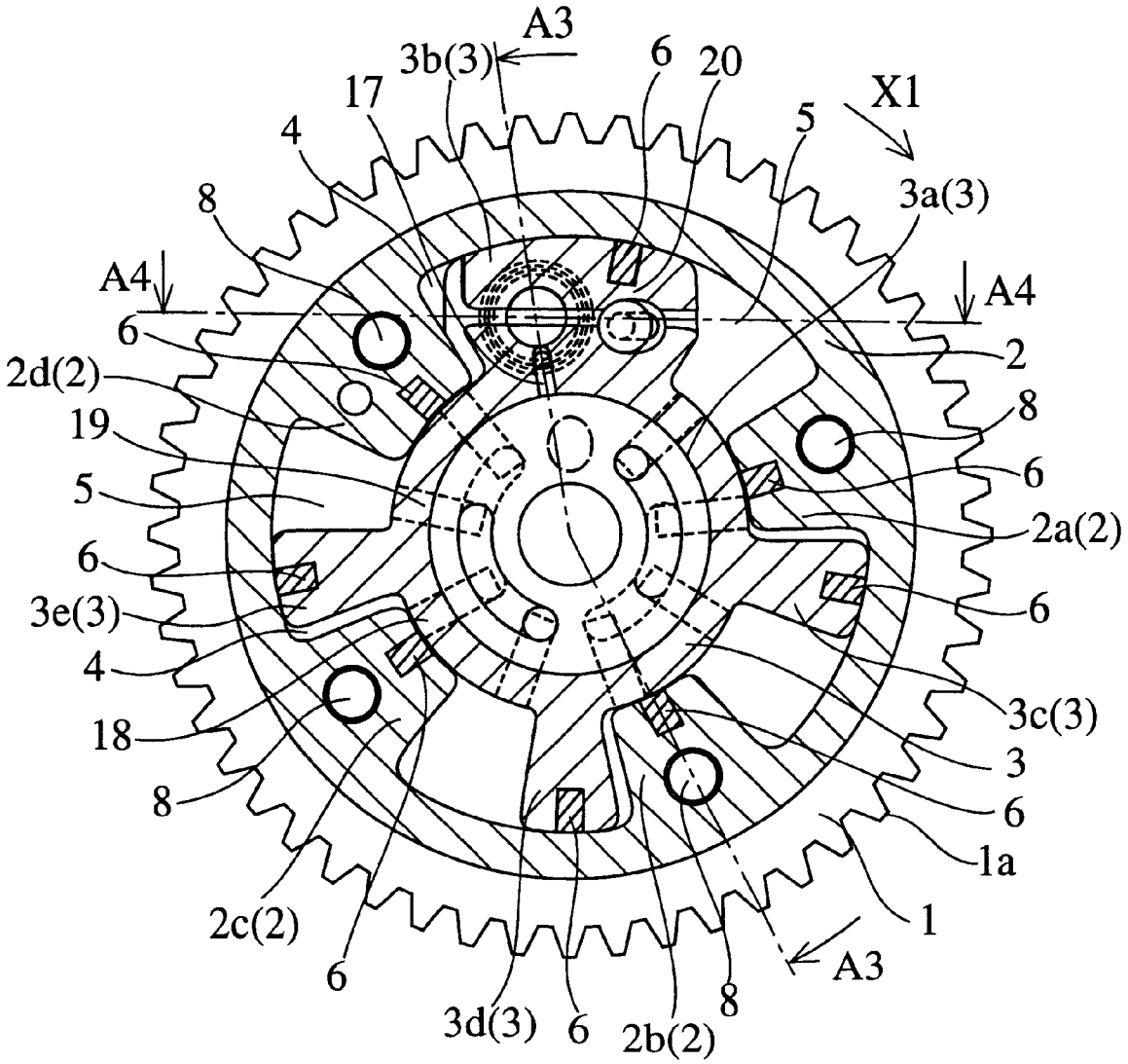
FIG. 6 is a lateral cross sectional view showing an internal construction of the VVT as embodiment 1 according to the present invention.
Figure 7:
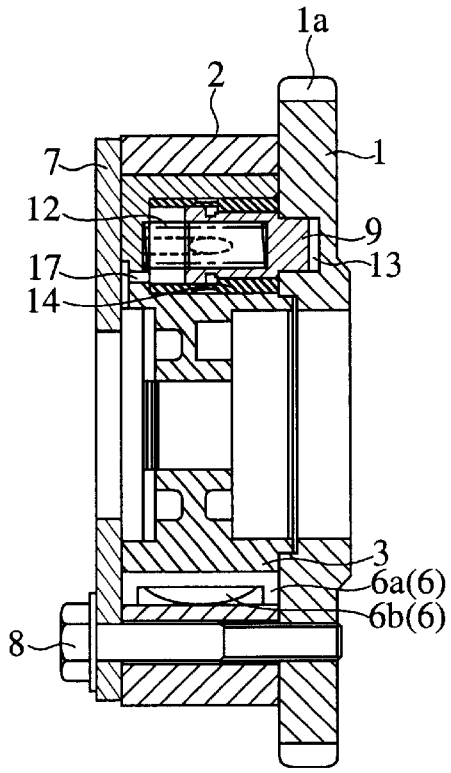
FIG. 7 is a longitudinal cross sectional view taken along lines A3—A3 of FIG. 6.
Figure 8:
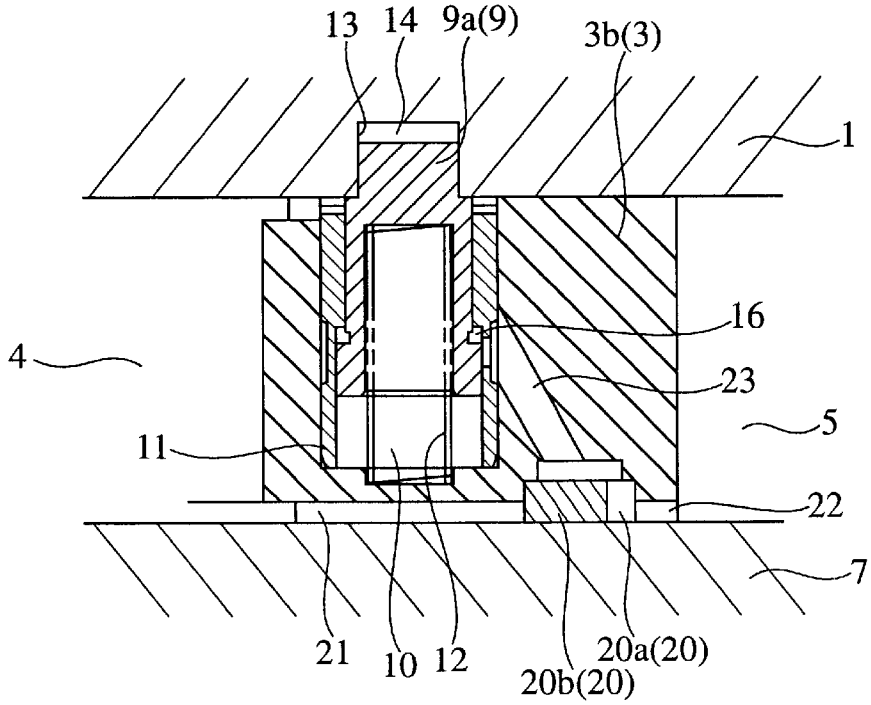
FIG. 8 is an enlarged cross sectional view taken along lines A4—A4 of FIG. 6, showing a tier control member locking the free rotation.
Figure 9A:
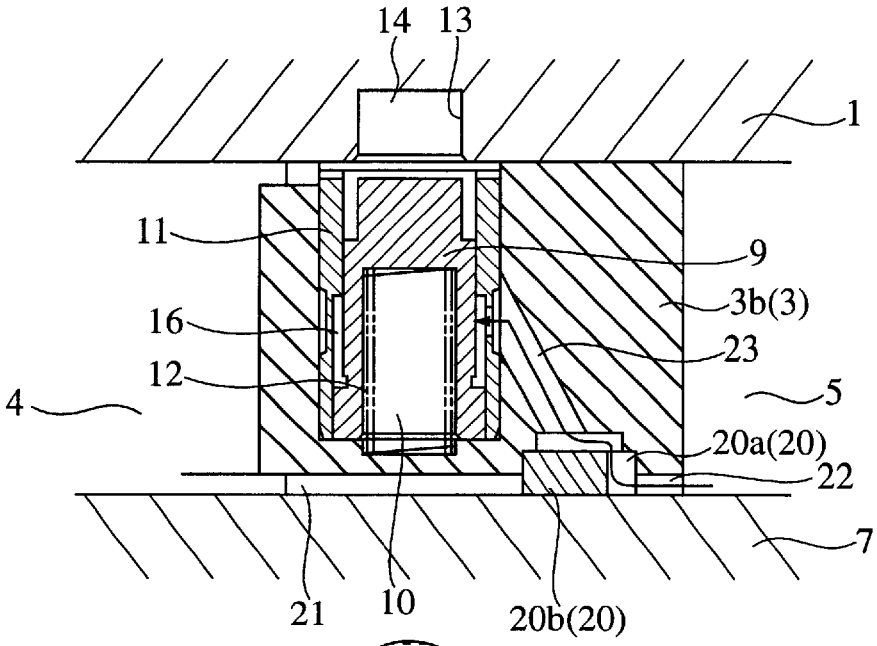
FIG. 9A is an enlarged cross sectional view taken along lines A4—A4 of FIG. 6, showing the tier control member releasing the lock of the free rotation due to a release hydraulic pressure supplied from a retardation side hydraulic pressure chamber.
Figure 9B:
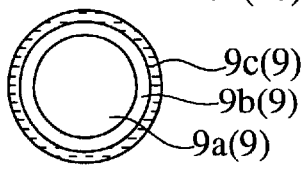
FIG. 9B is a plane view showing an area of a force-exerted face of the tier control member shown in FIG. 9A.
Figure 10A:
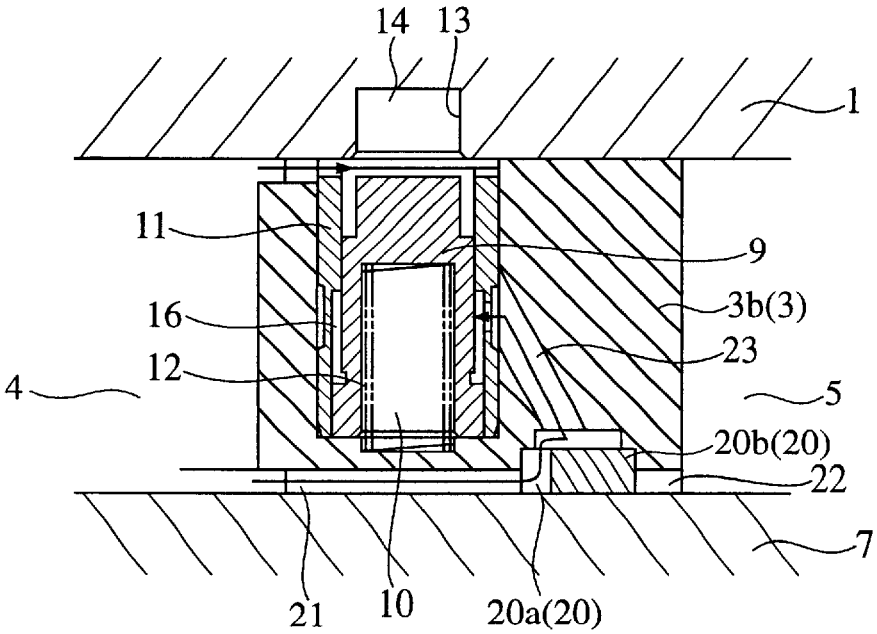
FIG. 10A is an enlarged cross sectional view taken along lines A4—A4 of FIG. 6, showing the tier control member releasing the lock of the free rotation due to a release hydraulic pressure supplied from an advance side hydraulic pressure chamber.
Figure 10B:
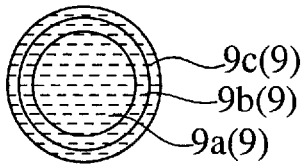
FIG. 10B is a plane view showing an area of a force-exerted face of the tier control member in FIG. 10A.

FIG. 6 is a lateral cross sectional view showing an internal construction of the VVT as embodiment 1 according to the present invention. FIG. 7 is a longitudinal cross sectional view taken along lines A3—A3 of FIG. 6. FIG. 8 is an enlarged cross sectional view taken along lines A4—A4 of FIG. 6, showing a tier control member locking the free rotation. FIG. 9A is an enlarged cross sectional view taken along lines A4—A4 of FIG. 6, showing the tier control member releasing the lock of the free rotation due to a release hydraulic pressure supplied from a retardation side hydraulic pressure chamber. FIG. 9B is a plane view showing an area of a force-exerted face of the tier control member shown in FIG. 9A. FIG. 10A is an enlarged cross sectional view taken along lines A4—A4 of FIG. 6, showing the tier control member releasing the lock of the free rotation due to a release hydraulic pressure supplied from an advance side hydraulic pressure chamber. FIG. 10B is a plane view showing an area of a force-exerted face of the tier control member in FIG. 10A. Components of the embodiment 1 common to the conventional components are denoted by the same reference numerals and further description will be omitted.

In the drawings, numeral 20 denotes a check valve arranged at an end of the vane 3*b* of the rotor 3 facing to the cover. The check valve 20 is a valve, which selects the higher hydraulic pressure of the advance side hydraulic pressure chamber 4 and the retardation side hydraulic pressure chamber 5. The selected hydraulic pressure communicates the second release hydraulic pressure chamber 16 with an advance side release hydraulic pressure passage 21 or a retardation side release hydraulic pressure passage 22 via a release hydraulic pressure passage 23. The passage 21 communicates with the advance side hydraulic pressure chamber 4, and the passage 22 communicates with the retardation side hydraulic pressure chamber 5. The check valve 20 includes a valve chamber 20*a* and a valve body 20*b* movable in the valve chamber 20*a* due to a hydraulic pressure. The passages 21 and 22 are formed along a boundary surface between the vane 3*b* of the rotor 3 and the cover 7. With the embodiment 1, the first release hydraulic pressure chamber 14 communicates with the advance side hydraulic pressure chamber 4 at all times via a passage as in the case of the conventional VVT shown in FIG. 1 to FIG. 5B. The passage is formed along the boundary surface between the end of the housing 1 facing to the case 2 and the end of the rotor 3 facing to the housing 1.

An operation will be hereafter explained.

When the engine is stopped, oil of the VVT returns to the oil pan (not shown). As shown in FIG. 8, the release hydraulic pressure is not supplied to any of the first release hydraulic pressure chamber 14 and the second release hydraulic pressure chamber 16. The lock pin 9 therefore moves forward (upward of FIG. 3) due to the biasing force of the coil spring 12, and then the front minor diameter section 9*a* of the lock pin 9 fits in the fitting hole 13. In this way, the second rotor is fixed at the maximum retarded side position with respect to the first rotor, and the relative rotation of the first and second rotors is locked.

When the engine is started, a hydraulic pressure supplied from the oil pump (not shown) is firstly supplied to the retardation side hydraulic pressure chamber 5 via the OCV (not shown). Here, the advance side hydraulic pressure chamber 4 functions as a drain, and the hydraulic pressure of the retardation side hydraulic pressure chamber 5 is higher than that of the advance side hydraulic pressure chamber 4. In such a case, a hydraulic pressure is supplied from the retardation side hydraulic pressure chamber 5 to the second release hydraulic pressure chamber 16 via the retardation side release hydraulic pressure passage 22, the check valve 20 and the release hydraulic pressure passage 23 as indicated by arrow of FIG. 9A. The release hydraulic pressure exerts on only a front-end face (end face in an axial direction) of the rear major diameter section 9*c* of the lock pin 9 as shown in FIG. 9B. The biasing force of the coil spring 12 therefore surpasses the release hydraulic pressure, and the lock of the lock pin 9 is not entire released although the lock pin 9 moves slightly back. The relative rotation of the first and second rotors is still locked, and accordingly the beat noise (abnormal noise) occurred due to a cam load is prevented.

The OCV (not shown) is then switched to supply a hydraulic pressure to the advance side hydraulic pressure chamber 4. The hydraulic pressure is supplied from the advance side hydraulic pressure chamber 4 to the first release hydraulic pressure chamber 14 via a passage defined at the end of the rotor 3 facing to the housing 1 as indicated by arrow of FIG. 10A. Concurrently, the hydraulic pressure is also supplied to the second release hydraulic pressure chamber 16 via the advance side release hydraulic pressure passage 21, the check valve 20 and the release hydraulic pressure passage 23. The release hydraulic pressure exerts on the front minor diameter section 9*a*, the central flange section 9*b* and the front-end face (end face in the axial direction) of the rear major diameter section 9*c* of the lock pin 9, in brief, the whole of the lock pin 9 as shown in FIG. 10B. In this way, the lock pin 9 moves backward the accommodation hole 10, and the front minor diameter section 9*a* of the lock pin 9 is finally disconnected from the accommodation hole 10 to allow the relative rotation of the first and second rotors.

Thus, when the hydraulic pressure is supplied to the retardation side hydraulic pressure chamber 5, it moves the lock pin 9 back without perfectly releasing the lock of the lock pin 9. In this way, when an oil passage is switched at the next stage, a time for moving the lock pin 9 back can be shortened in order to release perfectly the lock of the lock pin 9. At time of starting the relative rotation of the first and second rotors, the lock of the lock pin 9 can be released in good timing.

As described above, according to the embodiment 1, the advance side hydraulic pressure chamber 4 communicates with both of the first and second release hydraulic pressure chambers 14 and 16. The area of the force-exerted face of the lock pin 9 can therefore become large, and the biasing force of the coil spring 12 and the release hydraulic pressure can further become large. The lock/release operation of the lock pin-9 can be performed with reliability to ensure the high stability of operation. Moreover, according to the embodiment 1, the advance side hydraulic pressure chamber 4 communicates with both of the first and second release hydraulic pressure chambers 14 and 16. Even if the lock pin 9 is downsized without changing the biasing force of the coil spring 12, the area of the force-exerted face of the lock pin 9 can be increased. It can therefore ensure the high stability of operation without effect of the sliding resistance generated between the lock pin 9 and the holder 11 arranged in the accommodation hole 10.

With the embodiment 1, the first release hydraulic pressure chamber 14 communicates with the advance side hydraulic pressure chamber 4 at all times. When a hydraulic pressure of the advance side hydraulic pressure chamber 4 is applied, the advance side hydraulic pressure chamber 4 communicates with the second release hydraulic pressure chamber 16, which does not usually communicate with the advance side hydraulic pressure chamber 4, using the check valve 20 for example. The release hydraulic pressure supplied from the advance side hydraulic pressure chamber 4 can be easily supplied to both of the first and second release hydraulic pressure chambers 14 and 16, and the area of the force-exerted face of the lock pin 9 can be increased. In this way, it can ensure the high stability of operation.

With the embodiment 1, the release hydraulic pressure supplied to the second release hydraulic pressure chamber 16 via the check valve 20 exerts on a ring-shaped section defined at the end face of the rear major diameter section 9*c* of the lock pin 9 in the axial direction. In this way, the release hydraulic pressure supplied from the advance side hydraulic pressure chamber 4 can exert on the lock pin 9 with reliability. It can ensure the high stability of operation.

With the embodiment 1, the release hydraulic pressure exerts,on a circular section of the front minor diameter section 9*a* of the lock pin 9 in the first release hydraulic pressure chamber 14 communicating with the advance side hydraulic pressure chamber 4 at all times. In this way, the release hydraulic pressure supplied from the advance side hydraulic pressure chamber 4 can exert on the lock pin 9 with reliability. It can ensure the high stability of operation.

With the embodiment 1, the area of the force-exerted face of the lock pin 9 subject to the hydraulic pressure of the advance side hydraulic pressure chamber 4, is larger than that of the lock pin 9 subject to the hydraulic pressure of the retardation side hydraulic pressure chamber 5 as shown in FIG. 9B and FIG. 10B. Even if a release hydraulic pressure from the advance side hydraulic pressure chamber 4 is nearly equal to a release hydraulic pressure from the retardation side hydraulic pressure chamber 5, the lock of the lock pin 9 can be reliably released against the biasing force of the coil spring 12. It can therefore ensure the high stability of operation. Even if the lock of the lock pin 9 is not quite released due to the hydraulic pressure from the retardation side hydraulic pressure chamber 5, a time for moving the lock pin 9 back in the next stage can be shortened on application of the hydraulic pressure supplied from the advance side hydraulic pressure chamber 4. At time of starting the relative rotation of the first and second rotors, the lock of the lock pin 9 can be released in good timing.

With the embodiment 1, the advance side hydraulic pressure chamber 4 communicates with both of the first and second release hydraulic pressure chambers 14 and 16. Alternatively, the retardation side hydraulic pressure chamber 5 may communicate with both of the first and second release hydraulic pressure chambers 14 and 16.

With the embodiment 1, the area of the force-exerted face of the lock pin 9 subject to the hydraulic pressure of the advance side hydraulic pressure chamber 4, is larger than that of the lock pin 9 subject to the hydraulic pressure of the retardation side hydraulic pressure chamber 5. Alternatively, the former may be equal to the latter.

Embodiment 2

Figure 11:
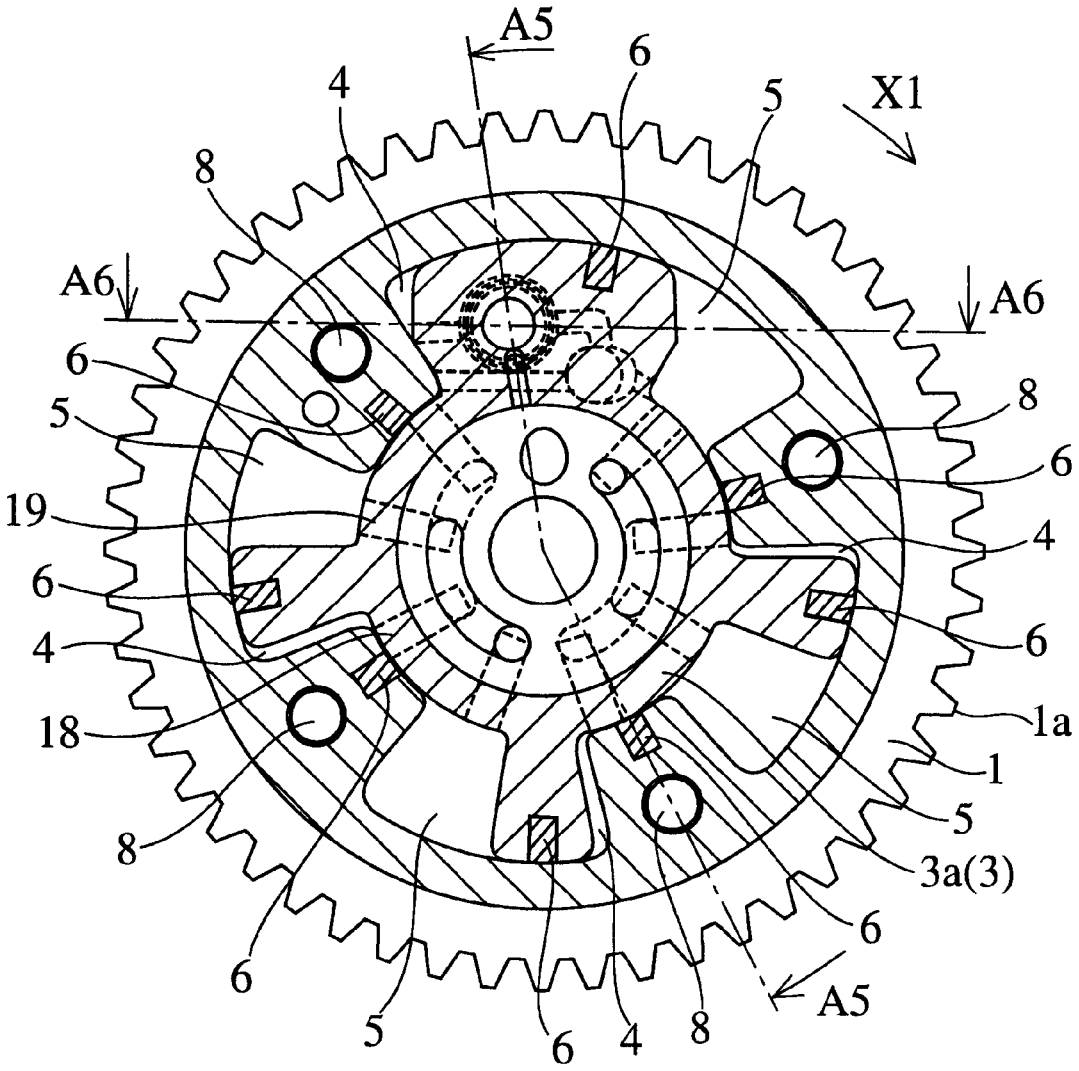
FIG. 11 is a lateral cross sectional view showing an internal construction of the VVT as embodiment 2 according to the present invention.
Figure 12:
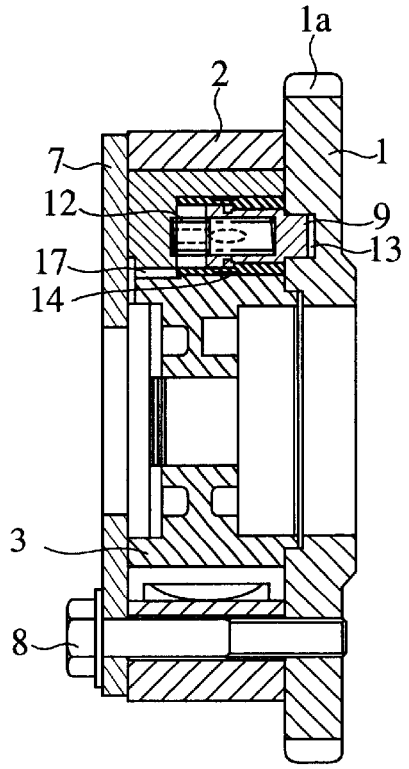
FIG. 12 is a longitudinal cross sectional view taken along lines A5—A5 of FIG. 11.
Figure 13:
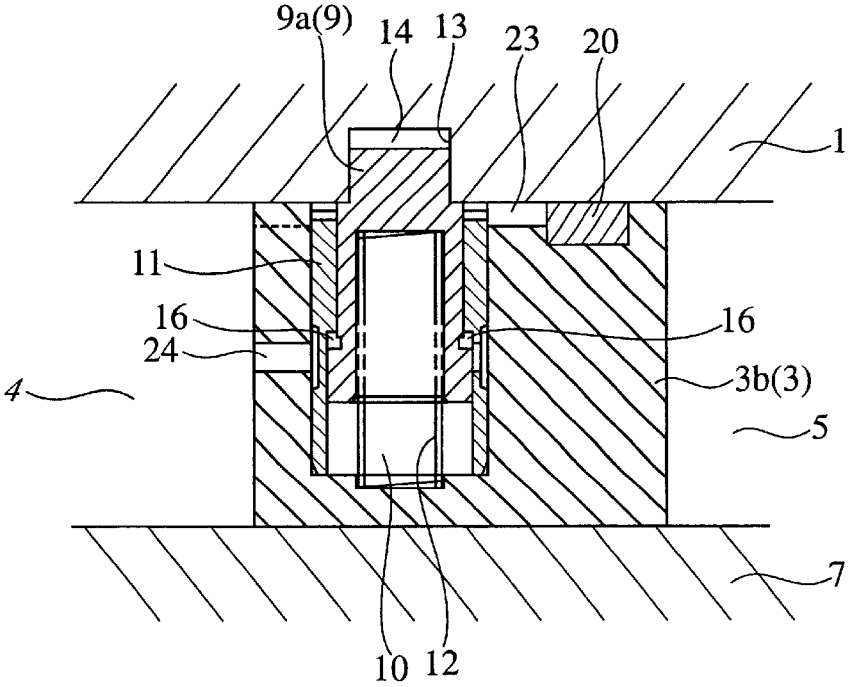
FIG. 13 is an enlarged cross sectional view taken along lines A6—A6 of FIG. 11, showing a tier control member locking the free rotation.
Figure 14A:
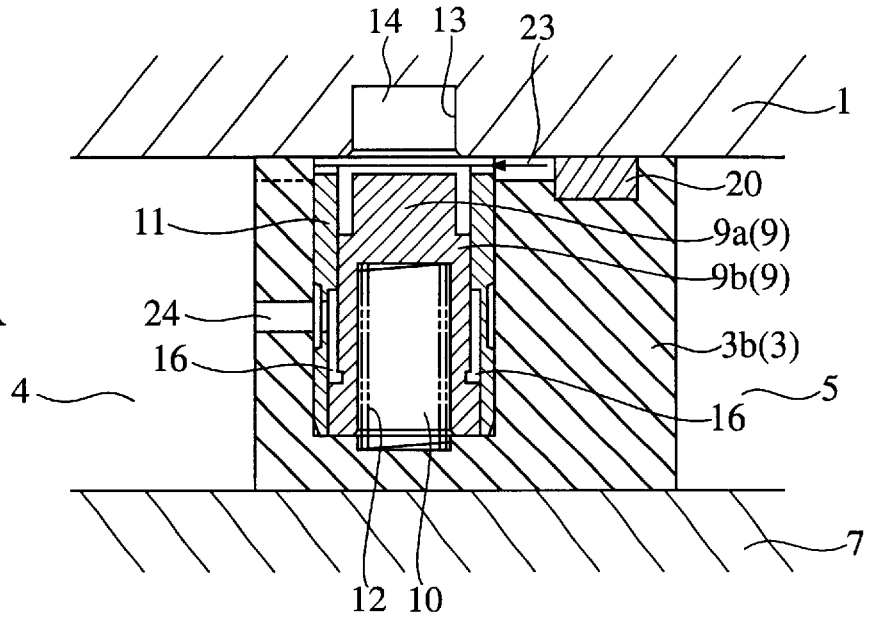
FIG. 14A is an enlarged cross sectional view taken along lines A6—A6 of FIG. 11, showing the tier control member releasing the lock of the free rotation due to a release hydraulic pressure supplied from a retardation side hydraulic pressure chamber.
Figure 14B:
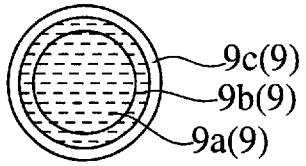
FIG. 14B is a plane view showing an area of a force-exerted face of the tier control member shown in FIG. 14A.
Figure 15A:
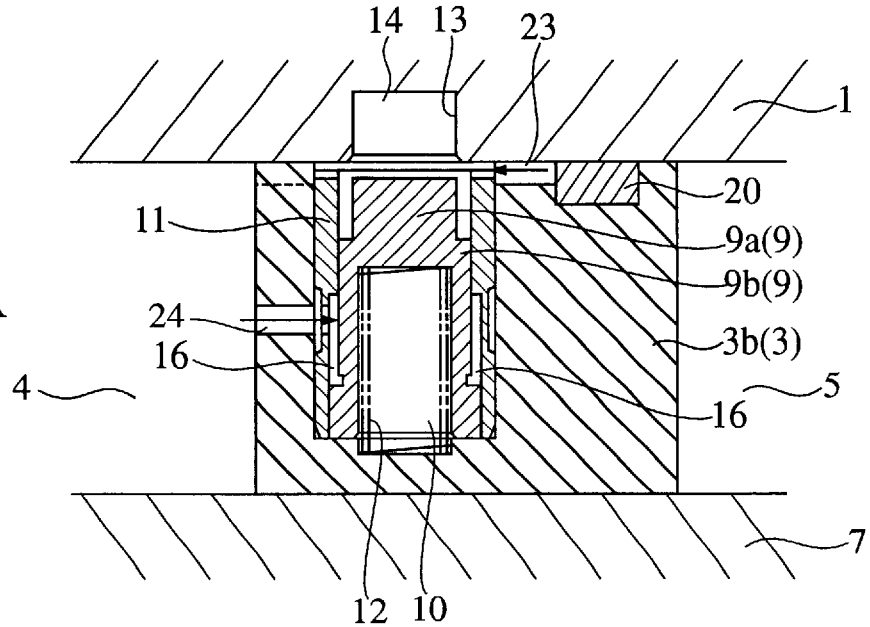
FIG. 15A is an enlarged cross sectional view taken along lines A6—A6 of FIG. 11, showing the tier control member releasing the lock of the free rotation due to a release hydraulic pressure supplied from an advance side hydraulic pressure chamber.
Figure 15B:
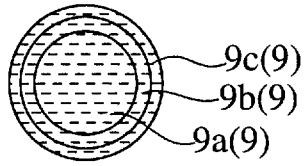
FIG. 15B is a plane view showing an area of a force-exerted face of the tier control member in FIG. 15A.

FIG. 11 is a lateral cross sectional view showing an internal construction of the VVT as embodiment 2 according to the present invention. FIG. 12 is a longitudinal cross sectional view taken along lines A5—A5 of FIG. 11. FIG. 13 is an enlarged cross sectional view taken along lines A6—A6 of FIG. 11, showing a tier control member locking the free rotation. FIG. 14A is an enlarged cross sectional view taken along lines A6—A6 of FIG. 11, showing the tier control member releasing the lock of the free rotation due to a release hydraulic pressure supplied from a retardation side hydraulic pressure chamber. FIG. 14B is a plane view showing an area of a force-exerted face of the tier control member shown in FIG. 14A. FIG. 15A is an enlarged cross sectional view taken along lines A6—A6 of FIG. 11, showing the tier control member releasing the lock of the free rotation due to a release hydraulic pressure supplied from an advance side hydraulic pressure chamber. FIG. 15B is a plane view showing an area of a force-exerted face of the tier control member in FIG. 15A. Components of the embodiment 2 common to the previous embodiments are denoted by the same reference numerals and further description will be omitted.

The embodiment 2 is characterized in that the check valve 20 is arranged at the end face of the vane 3*b* of the rotor 3 facing to the housing 1. The release hydraulic pressure passage 23 communicating with the check valve 20 further communicates with the first release hydraulic pressure chamber 14, and the second release hydraulic pressure chamber 16 communicates with the advance side hydraulic pressure chamber 4 via an advance side communication passage 24 at all times.

An operation will be hereafter explained.

When the engine is stopped, oil of the VVT returns to the oil pan (not shown). As shown in FIG. 13, the release hydraulic pressure is not supplied to any of the first release hydraulic pressure chamber 14 and the second release hydraulic pressure chamber 16. The lock pin 9 therefore moves forward (upward of FIG. 13) due to the biasing force of the coil spring 12, and then the front minor diameter section 9*a* of the lock pin 9 fits in the fitting hole 13. In this way, the second rotor is fixed at the maximum retarded side position with respect to the first rotor, and the relative rotation of the first and second rotors is locked.

When the engine is started, a hydraulic pressure supplied from the oil pump (not shown) is firstly supplied to the retardation side hydraulic pressure chamber 5 via the OCV (not shown). Here, the advance side hydraulic pressure chamber 4 functions as a drain, and the hydraulic pressure of the retardation side hydraulic pressure chamber 5 is higher than that of the advance side hydraulic pressure chamber 4. In the case, a hydraulic pressure is supplied from the retardation side hydraulic pressure chamber 5 to the first release hydraulic pressure chamber 14 via a retardation side communication passage (not shown), the check valve 20 and the release hydraulic pressure passage 23 as indicated by arrow of FIG. 14A. The release hydraulic pressure exerts on only the front minor diameter section 9*a* and a front-end face (end face in an axial direction) of the central flange section 9*b* of the lock pin 9 as shown in FIG. 14B. The biasing force of the coil spring 12 therefore surpasses the release hydraulic pressure, and the lock of the lock pin 9 is not entire released although the lock pin 9 moves slightly back. The relative rotation of the first and second rotors is still locked, and accordingly the beat noise (abnormal noise) occurred due to a cam load is prevented.

The OCV (not shown) is then switched to supply a hydraulic pressure to the advance side hydraulic pressure chamber 4. The hydraulic pressure is supplied from the advance side hydraulic pressure chamber 4 to the first release hydraulic pressure chamber 14 via an advance side release hydraulic pressure passage (not shown) and the check valve 20 as indicated by arrow of FIG. 15A. Concurrently, the hydraulic pressure is also supplied to the second release hydraulic pressure chamber 16 via the advance side communication passage 24. The release hydraulic pressure exerts on the front minor diameter section 9*a*, the central flange section 9*b* and the front-end face (end face in the axial direction) of the rear major diameter section 9*c* of the lock pin 9, in brief, the whole of the lock pin 9 as shown in FIG. 15B. In this way, the lock pin 9 moves backward the accommodation hole 10, and the front minor diameter section 9*a* of the lock pin 9 is finally disconnected from the accommodation hole 10 to allow the relative rotation of the first and second rotors.

Thus, when the hydraulic pressure is supplied to the retardation side hydraulic pressure chamber 5. it moves the lock pin 9 back without perfectly releasing the lock of the lock pin 9. In this way, when an oil passage is switched at the next stage, a time for moving the lock pin 9 back can be shortened in order to release perfectly the lock of the lock pin 9. At time of starting the relative rotation of the first and second rotors, the lock of the lock pin 9 can be released in good timing.

As described above, according to the embodiment 2, the advance side hydraulic pressure chamber 4 communicates with both of the first and second release hydraulic pressure chambers 14 and 16. The area of the force-exerted face of the lock pin 9 can therefore become large, and the biasing force of the coil spring 12 and the release hydraulic pressure can further become large. The lock/release operation of the lock pin 9 can be performed with reliability to ensure the high stability of operation. Moreover, according to the embodiment 2, the advance side hydraulic pressure chamber 4 communicates with both of the first and second release hydraulic pressure chambers 14 and 16. Even if the lock pin 9 is downsized without changing the biasing force of the coil spring 12, the area of the force-exerted face of the lock pin 9 can be increased. It can therefore ensure the high stability of operation without effect of the sliding resistance generated between the lock pin 9 and the holder 11 arranged in the accommodation hole 10.

With the embodiment 2, the second release hydraulic pressure chamber 16 communicates with the advance side hydraulic pressure chamber 4 via the advance side communication passage 24 at all times. When a hydraulic pressure of the advance side hydraulic pressure chamber 4 is applied, the advance side hydraulic pressure chamber 4 communicates with the first release hydraulic pressure chamber 14, which does not usually communicate with the advance side hydraulic pressure chamber 4, using the check valve 20 for example. The release hydraulic pressure supplied from the advance side hydraulic pressure chamber 4 can be easily supplied to both of the first and second release hydraulic pressure chambers 14 and 16, and the area of the force-exerted face of the lock pin 9 can be increased. In this way, it can ensure the high stability of operation.

With the embodiment 2, the release hydraulic pressure supplied to the first release hydraulic pressure chamber 14 via the check valve 20 exerts on a circular section of the front minor diameter section 9*a* of the lock pin 9. In this way, the release hydraulic pressure supplied from the advance side hydraulic pressure chamber 4 can exert on the lock pin 9 with reliability. It can ensure the high stability of operation.

With the embodiment 2, the release hydraulic pressure exerts on a ring-shaped section defined at the end face of the rear major diameter section 9*c* of the lock pin 9 in the axial direction in the second release hydraulic pressure chamber 16 communicating with the advance side hydraulic pressure chamber 4 at all times.

In this way, the release hydraulic pressure supplied from the advance side hydraulic pressure chamber 4 can exert on the lock pin 9 with reliability. It can ensure the high stability of operation.

With the embodiment 2, the area of the force-exerted face of the lock pin 9 subject to the hydraulic pressure-of the advance side hydraulic pressure chamber 4, is larger than that of the lock pin 9 subject to the hydraulic pressure of the retardation side hydraulic pressure chamber 5 as shown in FIG. 14B and FIG. 15B. Even if a release hydraulic pressure from the advance side hydraulic pressure chamber 4 is nearly equal to a release hydraulic pressure from the retardation side hydraulic pressure chamber 5, the lock of the lock pin 9 can be reliably released against the biasing force of the coil spring 12. It can therefore ensure the high stability of operation. Even if the lock of the lock pin 9 is not quite released due to the hydraulic pressure from the retardation side hydraulic pressure chamber 5, a time for moving the lock pin 9 back in the next stage can be shortened on application of the hydraulic pressure supplied from the advance side hydraulic pressure chamber 4. At time of starting the relative rotation of the first and second rotors, the lock of the lock pin 9 can be released in good timing.

Embodiment 3

Figure 16:
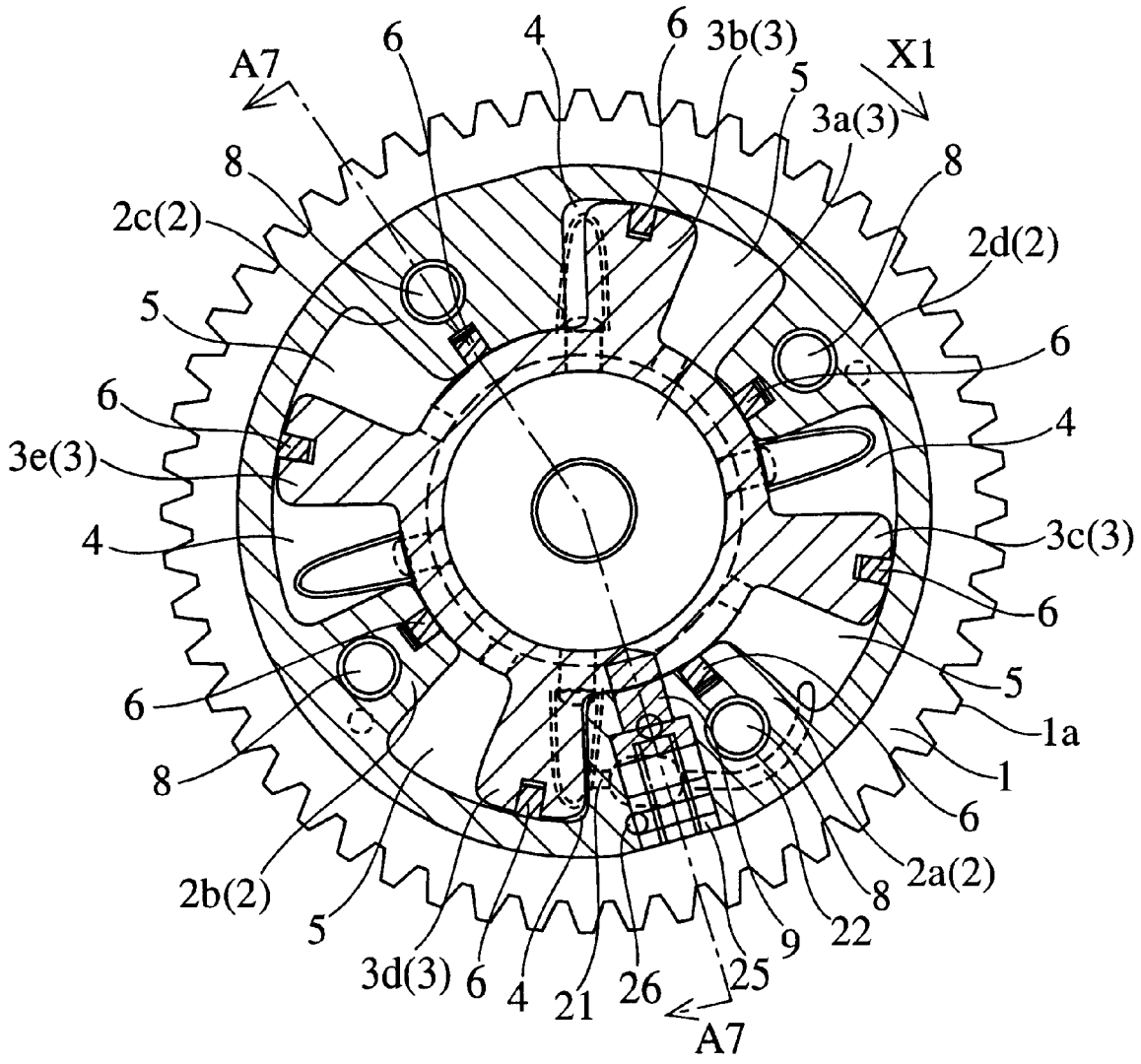
FIG. 16 is a lateral cross sectional view showing an internal construction of the VVT as embodiment 3 according to the present invention.
Figure 17:
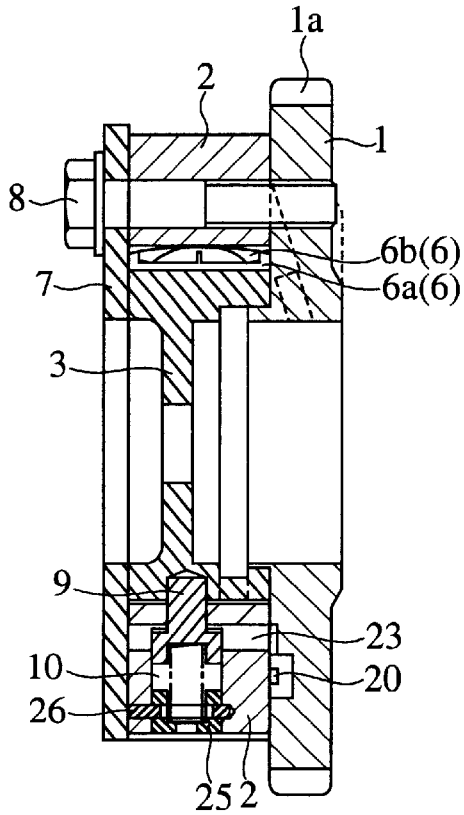
FIG. 17 is a longitudinal cross sectional view taken along lines A7—A7 of FIG. 16.
Figure 18:
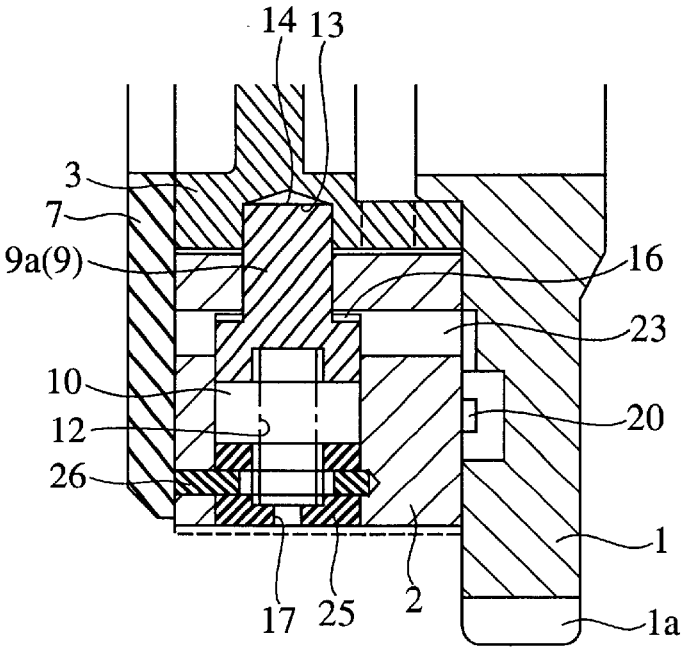
FIG. 18 is an enlarged cross sectional view showing a tier control member locking the free rotation in the VVT shown in FIG. 17.
Figure 19A:
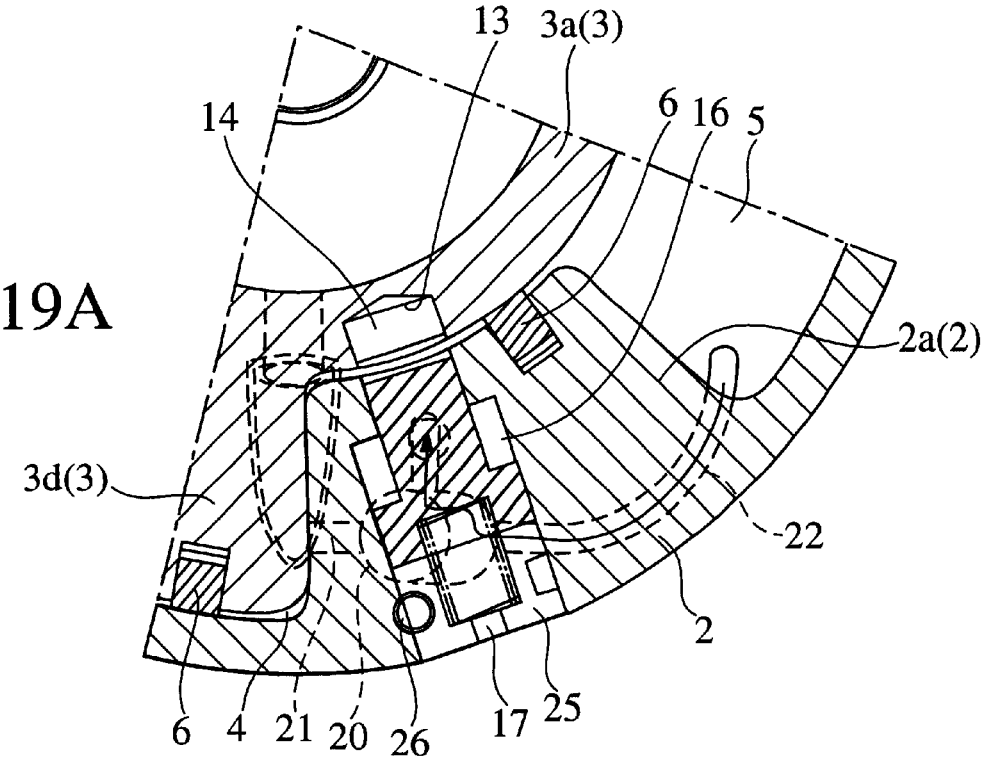
FIG. 19A is an enlarged lateral cross sectional view partially showing the tier control member releasing the lock of the free rotation due to a release hydraulic pressure supplied from a retardation side hydraulic pressure chamber shown in FIG. 16.
Figure 19B:
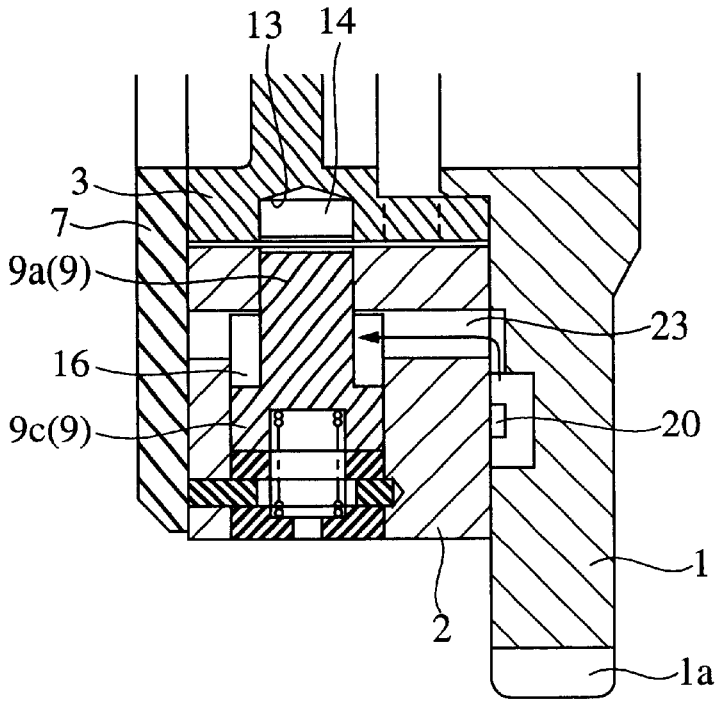
FIG. 19B is an enlarged longitudinal cross sectional view shown in FIG. 19A.
Figure 19C:
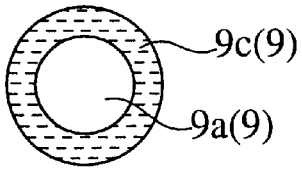
FIG. 19C is a plane view showing an area of a force-exerted face of the tier control member shown in FIG. 19A and FIG. 19B.
Figure 20A:
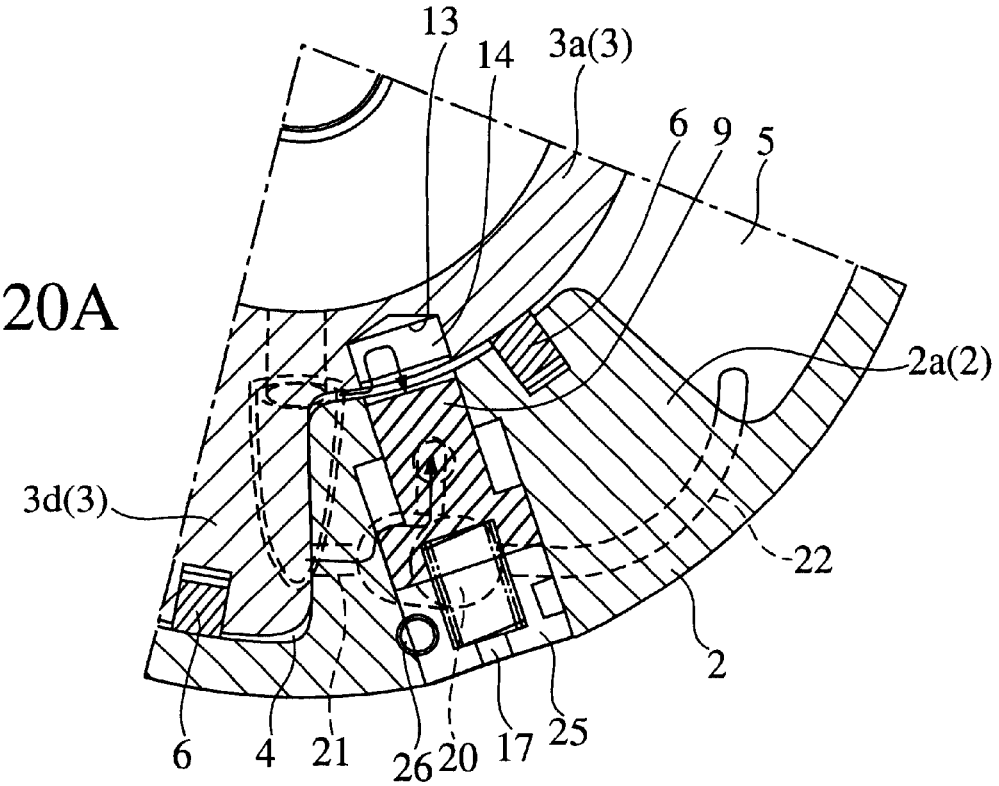
FIG. 20A is an enlarged lateral cross sectional view partially showing the tier control member releasing the lock of the free rotation due to a release hydraulic pressure supplied from an advance side hydraulic pressure chamber shown in FIG. 16.
Figure 20B:
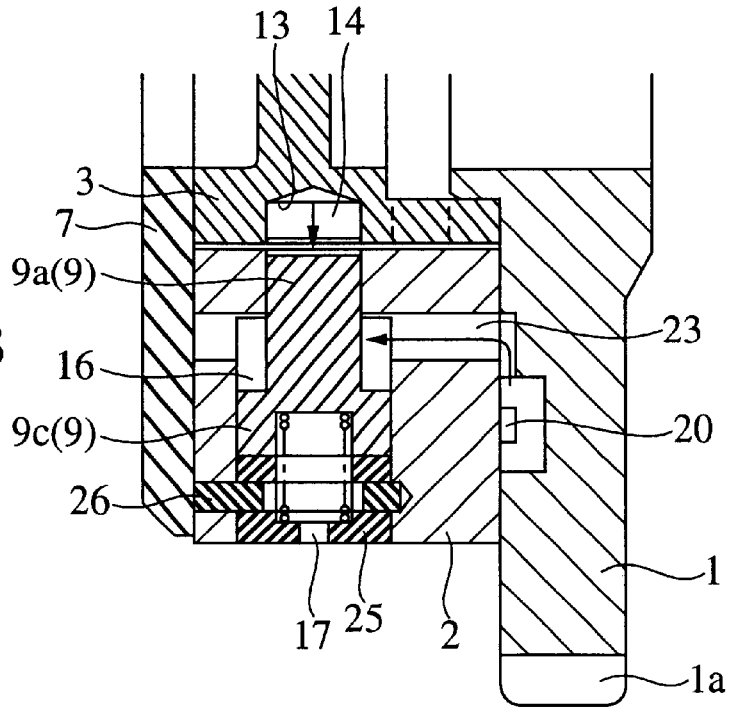
FIG. 20B is an enlarged longitudinal cross sectional view shown in FIG. 20A.
Figure 20C:
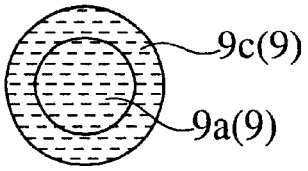
FIG. 20C is a plane view showing an area of a force-exerted face of the tier control member shown in FIG. 20A and FIG. 20B.

FIG. 16 is a lateral cross sectional view showing an internal construction of the VVT as embodiment 3 according to the present invention. FIG. 17 is a longitudinal cross sectional view taken along lines A7—A7 of FIG. 16. FIG. 18 is an enlarged cross sectional view showing a tier control member locking the free rotation in the VVT shown in FIG. 17. FIG. 19A is an enlarged lateral cross sectional view partially showing the tier control member releasing the lock of the free rotation due to a release hydraulic pressure supplied from a retardation side hydraulic pressure chamber shown in FIG. 16. FIG. 19B is an enlarged longitudinal cross sectional view shown in FIG. 19A. FIG. 19C is a plane view showing an area of a force-exerted face of the tier control member shown in FIG. 19A and FIG. 19B. FIG. 20A is an enlarged lateral cross sectional view partially showing the tier control member releasing the lock of the free rotation due to a release hydraulic pressure supplied from an advance side hydraulic pressure chamber shown in FIG. 16. FIG. 20B is an enlarged longitudinal cross sectional view shown in FIG. 20A. FIG. 20C is a plane view showing an area of a force-exerted face of the tier control member shown in FIG. 20A and FIG. 20B. Components of the embodiment 3 common to the previous embodiments are denoted by the same reference numerals and further description will be omitted.

With the embodiment 3, the accommodation hole 10 extending in a radius direction of the device is formed in the shoe 2*a* of the case 2. The fitting hole 13 is formed at the boss section 3*a* of the rotor 3. The check valve 20 is formed at the end face of the housing 1 facing to the case 2. The release hydraulic pressure passage 23 is formed within the shoe 2*a* of the case 2. A holder 25 is fitted to outside of the accommodation hole 10 (an outermost section of the device), and prevents disconnection of the lock pin 9 and the coil spring 12 from the accommodation hole 10. The holder 25 is fixed with a pin 26 in the accommodation hole 10. The discharge hole 17 is formed at a central portion of the holder 25. The lock pin 9 of the embodiment 3 is different from those of the embodiments 1 and 2, does not have the central flange section 9*b*, and includes the front minor diameter section 9*a*, the rear major diameter section 9*c* and the hollow section 9*d*.

An operation will be hereafter explained.

When the engine is stopped, oil of the VVT returns to the oil pan (not shown). As shown in FIG. 18, the release hydraulic pressure is not supplied to any of the first release hydraulic pressure chamber 14 and the second release hydraulic pressure chamber 16. The lock pin 9 therefore moves forward (upward of FIG. 18) due to the biasing force of the coil spring 12, and then the front minor diameter section 9*a* of the lock pin 9 fits in the fitting hole 13. In this way, the second rotor is fixed at the maximum retarded side position with respect to the first rotor, and the relative rotation of the first and second rotors is locked.

When the engine is started, a hydraulic pressure supplied. from the oil pump (not shown) is firstly supplied to the retardation side hydraulic pressure chamber 5 via the OCV (not shown). Here, the advance side hydraulic pressure chamber 4 functions as a drain, and the hydraulic pressure of the retardation side hydraulic pressure chamber 5 is higher than that of the advance side hydraulic pressure chamber 4. In the case, a hydraulic pressure is supplied from the retardation side hydraulic pressure chamber 5 to the second release hydraulic pressure chamber 16 via the retardation side communication passage (not shown), the check valve 20 and the release hydraulic pressure passage 23 as indicated by arrow of FIG. 19A and FIG. 19B. The release hydraulic pressure exerts on only the front-end face (end face in the axial direction) of the rear major diameter section 9*c* of the lock pin 9 as shown in FIG. 19C. The biasing force of the coil spring 12 therefore surpasses the release hydraulic pressure, and the lock of the lock pin 9 is not entire released although the lock pin 9 moves slightly back. The relative rotation of the first and second rotors is still locked, and accordingly the beat noise (abnormal noise) occurred due to a cam load is prevented.

The OCV (not shown) is then switched to supply a hydraulic pressure to the advance side hydraulic pressure chamber 4. The hydraulic pressure is supplied from the advance side hydraulic pressure chamber 4 to the second release hydraulic pressure chamber 16 via the advance side release hydraulic pressure passage (not shown) and the check valve 20 as indicated by arrow of FIG. 20A and FIG. 20B. Concurrently, the hydraulic pressure is also supplied to the first release hydraulic pressure chamber 14 via a gap defined between the outer peripheral surface of the boss section 3*a* of the rotor 3 and an inner peripheral surface of the shoe 2*a* of the case 2. The release hydraulic pressure exerts on the front minor diameter section 9*a* and the front-end face (end face in the axial direction) of the rear major diameter section 9*c* of the lock pin 9, in brief, the whole of the lock pin 9 as shown in FIG. 20C. In this way, the lock pin 9 moves backward the accommodation hole 10, and the front minor diameter section 9*a* of the lock pin 9 is finally disconnected from the accommodation hole 10 to allow the relative rotation of the first and second rotors.

Thus, when the hydraulic pressure is supplied to the retardation side hydraulic pressure chamber 5, it moves the lock pin 9 back without perfectly releasing the lock of the lock pin 9. In this way, when an oil passage is switched at the next stage, a time for moving the lock pin 9 back can be shortened in order to release perfectly the lock of the lock pin 9. At time of starting the relative rotation of the first and second rotors, the lock of the lock pin 9 can be released in good timing.

As described above, according to the embodiment 3, the advance side hydraulic pressure chamber 4 communicates with both of the first and second release hydraulic pressure chambers 14 and 16. The area of the force-exerted face of the lock pin 9 can therefore become large, and the biasing force of the coil spring 12 and the release hydraulic pressure can further become large. The lock/release operation of the lock pin 9 can be performed with reliability to ensure the high stability of operation. Moreover, according to the embodiment 3, the advance side hydraulic pressure chamber 4 communicates with both of the first and second release hydraulic pressure chambers 14 and 16. Even if the lock pin 9 is downsized without changing the biasing force of the coil spring 12, the area of the force-exerted face of the lock pin 9 can be increased. It can therefore ensure the high stability of operation without effect of the sliding resistance generated between the lock pin 9 and an inner wall of the accommodation hole 10.

With the embodiment 3, the first release hydraulic pressure chamber 14 communicates with the advance side hydraulic pressure chamber 4 at all times. When a hydraulic pressure of the advance side hydraulic pressure chamber 4 is applied, the advance side hydraulic pressure chamber 4 communicates with the second release hydraulic pressure chamber 16, which does not usually communicate with the advance side hydraulic pressure chamber 4, using the check valve 20 for example. The release hydraulic pressure supplied from the advance side hydraulic pressure chamber 4 can be easily supplied to both of the first and second release hydraulic pressure chambers 14 and 16, and the area of the force-exerted face of the lock pin 9 can be increased. In this way, it can ensure the high stability of operation.

With the embodiment 3, the release hydraulic pressure supplied to the second release hydraulic pressure chamber 16 via the check valve 20 exerts on a ring-shaped section defined at the end face of the rear major diameter section 9*c* of the lock pin 9 in the axial direction. In this way, the release hydraulic pressure supplied from the advance side hydraulic pressure chamber 4 can exert on the lock pin 9 with reliability. It can ensure the high stability of operation.

With the embodiment 3, the release hydraulic pressure exerts on a circular section of the front minor diameter section 9*a* of the lock pin 9 in the first release hydraulic pressure chamber 14 communicating with the advance side hydraulic pressure chamber 4 at all times. In this way, the release hydraulic pressure supplied from the advance side hydraulic pressure chamber 4 can exert on the lock pin 9 with reliability. It can ensure the high stability of operation.

With the embodiment 3, the area of the force-exerted face of the lock pin 9 subject to the hydraulic pressure of the advance side hydraulic pressure chamber 4, is larger than that of the lock pin 9 subject to the hydraulic pressure of the retardation side hydraulic pressure chamber 5 as shown in FIG. 19C and FIG. 20C. Even if a release hydraulic pressure from the advance side hydraulic pressure chamber 4 is nearly equal to a release hydraulic pressure from the retardation side hydraulic pressure chamber 5, the lock of the lock pin 9 can be reliably released against the biasing force of the coil spring 12. It can therefore ensure the high stability of operation. Even if the lock of the lock pin 9 is not quite released due to the hydraulic pressure from the retardation side hydraulic pressure chamber 5, a time for moving the lock pin 9 back in the next stage can be shortened on application of the hydraulic pressure supplied from the advance side hydraulic pressure chamber 4. At time of starting the relative rotation of the first and second rotors, the lock of the lock pin 9 can be released in good timing.

Embodiment 4

Figure 21:
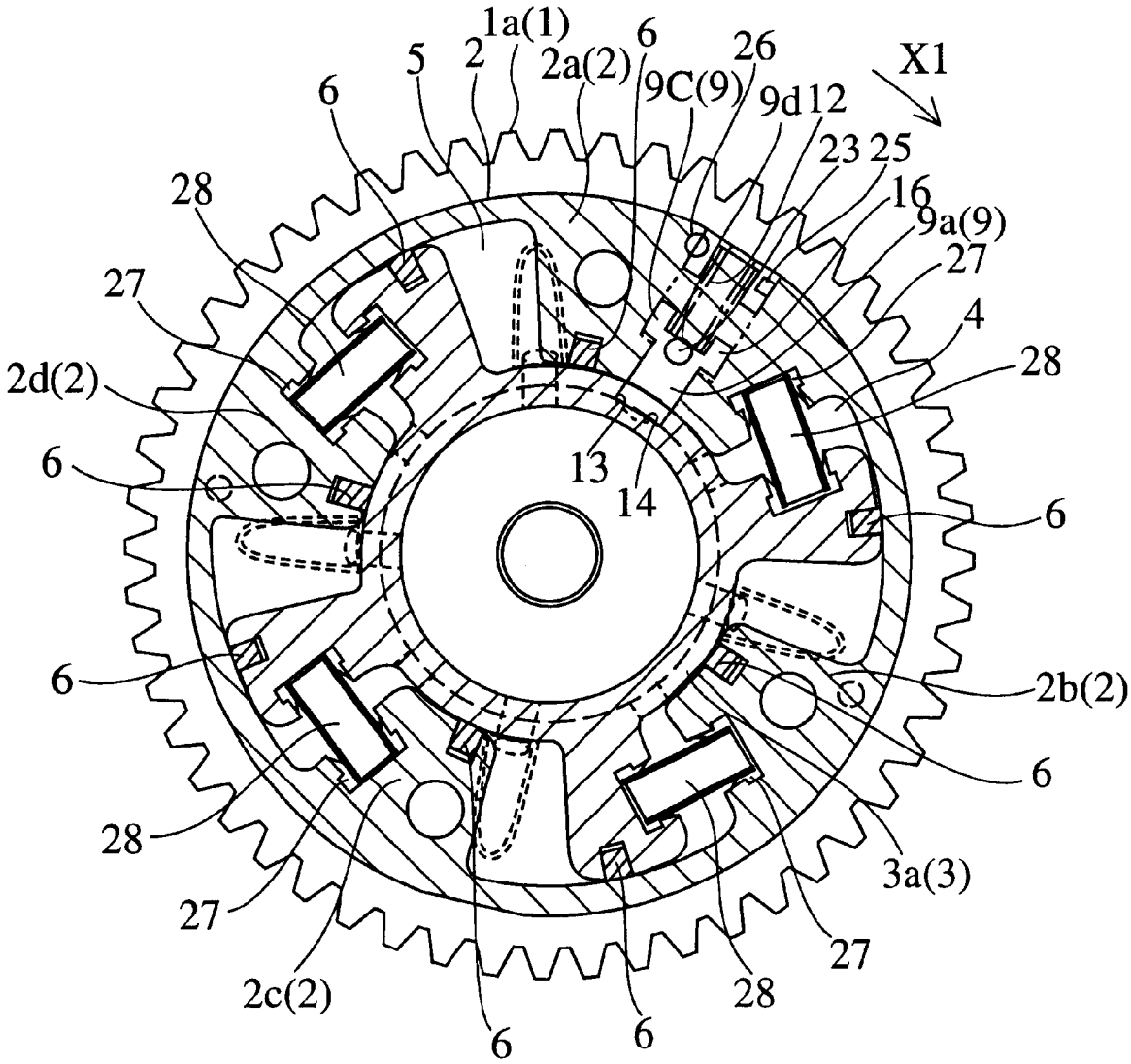
FIG. 21 is a lateral cross sectional view showing an internal construction of the VVT as embodiment 4 according to the present invention.

FIG. 21 is a lateral cross sectional view showing an internal construction of the VVT as embodiment 4 according to the present invention. Components of the embodiment 4 common to the previous embodiments are denoted by the same reference numerals and further description will be omitted.

The embodiment 4 is different from the embodiment 1 to the embodiment 3, and relates to an intermediate position lock type of VVT.

With the intermediate position lock type of VVT, the rotor 3 acting as the second rotor is locked at the intermediate position defined between the maximum retarded side position and the maximum advanced side position with respect to the case 2 constituting a part of the first rotor. The maximum advanced side position means a position of the second rotor, which advances at the maximum level with respect to the first rotor. Concretely, the fitting hole 13 is formed at the intermediate position defined at the outer peripheral surface of the boss section 3*a* of the rotor 3. The accommodation hole 10 extending in the radius direction of the device is formed at the shoe 2*a* of the case 2 as in the case of the embodiment 3. The holder 25 is fitted to outside of the accommodation hole 10 (the outer most section of the device), and prevents disconnection of the lock pin 9 and the coil spring 12 from the accommodation hole 10. The holder 25 is fixed with the pin 26 in the accommodation hole 10. The discharge hole 17 is formed at a central portion of the holder 25. The lock pin 9 of the embodiment 4 does not have the central flange section 9*b*, and acts as the tier control member which includes the front minor diameter section 9*a*, the rear major diameter section 9*c* and the hollow section 9*d* as in the case of the embodiment 3.

Assist springs 28 are arranged between the shoes 2*a*, 2*b*, 2*c* and 2*d* of the case 2 and the vanes 3*b*, 3*c*, 3*d* and 3*e* of the rotor 3, respectively. The respective assist springs 28 is held due to the holder 27, and biases the rotor 3 toward the case in an advance direction (direction indicated by arrow X1 of FIG. 21).

The seal members are disposed between a lock system, which is constituted by the lock pin 9 and the fitting hole 13, and the retardation side hydraulic pressure chamber 5. When a hydraulic pressure of the advance side hydraulic pressure chamber 4 is used as the release hydraulic pressure, the hydraulic pressure of the advance side hydraulic pressure chamber 4 is applied to the rear major diameter section 9*c* of the lock pin 9 via the check valve 20, the release hydraulic pressure passage 23 and the second release hydraulic pressure chamber 16. Concurrently, the hydraulic pressure of the advance side hydraulic pressure chamber 4 is also applied to the front minor diameter section 9*a* of the lock pin 9 fitted in the fitting hole 13 via a slight gap defined between a front-end face of the shoe 2*a* of the case 2 and the outer peripheral surface of the boss section 3*a* of the rotor 3.

When the hydraulic pressure of the retardation side hydraulic pressure chamber 5 is used as a release hydraulic pressure, the release hydraulic pressure is supplied to the second release hydraulic pressure chamber 16 via the check valve 20 and the release hydraulic pressure passage 23. Here, the release hydraulic pressure exerts on only the rear major diameter section 9*c* of the lock pin 9.

As described above, according to the embodiment 4, the seal member 6 is disposed between the fitting hole 13 and the retardation side hydraulic pressure chamber 5. The advance side hydraulic pressure chamber 4 can therefore communicate with both of the first and second release hydraulic pressure chambers 14 and 16. The area of the force-exerted face of the lock pin 9 can become large on application of the release hydraulic pressure from the advance side hydraulic pressure chamber 4, and the biasing force of the coil spring 12 and the release hydraulic pressure can therefore become large. The lock/release operation of the lock pin 9 can be performed with reliability to ensure the high stability of operation. Moreover, according to the embodiment 4, even if the lock pin 9 is downsized without changing the biasing force of the coil spring 12, the area of the force-exerted face of the lock pin 9 can be increased. It can therefore ensure the high stability of operation without effect of the sliding resistance generated between the lock pin 9 and the accommodation hole 10.

Incidentally, the intermediate position lock type of the VVT has typical problems derived from the typical construction, which is different from the conventional valve timing control devices such as the maximum advanced side position lock type or the maximum retarded side position lock type.

First, with the maximum advanced side position lock type or the maximum retarded side position lock type of the valve timing control device, when the lock pin is able to fit in the fitting hole, a hydraulic pressure is applied on the rotor to press the rotor toward the lock position. Here, contact of the vanes of the rotor is ensured with shoes of the case at the maximum advanced side position or the maximum retarded side position. Therefore, since no force apply on the lock pin, the lock pin does not catch on with the other parts. Further, even if a hydraulic pressure in the VVT is reduced when operation oil is consumed by operation of the device or when a hydraulic pressure passage in the OCV side becomes narrow in a hydraulic pressure supply mode of the OCV side (hereafter, referred as OCV intermediate retained mode) for keeping the rotor with respect to the case at the intermediate position on normal operation, the lock pin does not fit or catch on or engage between the maximum advanced side position and the maximum retarded side position because the fitting hole is arranged at a position other than the lock position. Since the lock pin does not catch on or engage with the fitting hole, the valve timing control device is disabled during normal operation or in an intermediate retained state.

On the other hand, with the intermediate position lock type of valve timing control device, the fitting hole is arranged at the approximately intermediate position apart from both of the maximum advanced side position and the maximum retarded side position. First, when the rotor is held with respect to the case at the about intermediate position due to the hydraulic pressure supplied from the OCV, the hydraulic pressure passage in the OCV side narrows when in the OCV intermediate retained mode. A hydraulic pressure in the advance side hydraulic pressure chamber or the retardation side hydraulic pressure chamber and a release hydraulic pressure chamber is therefore substantially reduced to one half of the hydraulic pressure in the OCV and the release hydraulic pressure is not sufficient. As a result, the lock pin sometimes catches on in or fitted in the fitting hole. In this case, there is a minor problem that the lock pin and the fitting hole undergo wear which reduces their durability, and that the valve timing control device becomes incapable of operation from the intermediate retained state. Second, when the lock pin is operated beyond the fitting hole as the intermediate lock position and the release hydraulic pressure is reduced associated with the reduction of the hydraulic pressure in the advance side hydraulic pressure chamber or the retardation side hydraulic pressure chamber which is generated by consuming the operating oil used for the operation of the device, the lock pin pops up due to the pushing force of the pushing member under operation condition and catches on in the fitting hole to prevent operation.

The minor problem described above can be resolved due to the intermediate position lock type of the VVT according to the embodiment 4. In short, according to the embodiment 4, the seal member 6 is disposed between the lock system and the retardation side hydraulic pressure chamber 5. It is possible to supply the release hydraulic pressure of the retardation side hydraulic pressure chamber 5 to the second release hydraulic pressure chamber 16, and to supply the release hydraulic pressure of the advance side hydraulic pressure chamber 4 to the first and second release hydraulic pressure chambers 14 and 16. For example, in the OCV intermediate retained mode, the hydraulic pressure of the advance side hydraulic pressure chamber 4 can be used as a lock pin release hydraulic pressure. Here, in the OCV intermediate retained mode, a larger hydraulic pressure is supplied to the advance side hydraulic pressure chamber in order to go against the cam load. When the lock pin is therefore released due to the hydraulic pressure of the advance side hydraulic pressure chamber 4 in the OCV intermediate retained mode, it is difficult to reduce an effective release hydraulic pressure. The release hydraulic pressure, which is supplied from the advance side hydraulic pressure chamber 4, exerts on the lock pin 9 with reliability to retain a released state, and prevents an accidental engagement of the lock pin to ensure the high stability of operation.

The present invention maybe embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A valve timing control device, comprising:

a first rotor rotating in synchronization with a crankshaft of an internal combustion engine and having a plurality of shoes which are projected inwardly to define a plurality of hydraulic pressure chambers;

a second rotor fixed at an end of a camshaft of the internal combustion engine and having a plurality of vanes which partition the plural hydraulic pressure chambers of the first rotor into an advance side hydraulic pressure chamber and a retardation side hydraulic pressure chamber;

a fitting hole disposed at any one of the first rotor or the second rotor;

a tier control member fitting in the fitting hole to control a relative rotation of the first and second rotors and having a front minor diameter section and a rear major diameter section;

an accommodation hole disposed at the other to accommodate the tier control member;

a biasing member biasing the tier control member in a direction of fitting the tier control member in the fitting hole;

a first release hydraulic pressure chamber defined between the front minor diameter section of the tier control member and the fitting hole; and a second release hydraulic pressure chamber defined between an end face of the rear major diameter section of the tier control member in an axial direction of the device and the accommodation hole, wherein at least one of the first and second release hydraulic pressure chambers communicates with both the advance and retardation side hydraulic pressure chambers.

2. A valve timing control device according to claim 1, wherein the first release hydraulic pressure chamber or the second release hydraulic pressure chamber communicates with the advance side hydraulic pressure chamber at all times.

3. A valve timing control device according to claim 1, further comprising a check valve supplying the higher hydraulic pressure of the advance and retardation side hydraulic pressure chambers to the tier control member as a release hydraulic pressure for releasing the lock of the tier control member, wherein at least one of the first and second release hydraulic pressure chambers communicates with both the advance and retardation side hydraulic pressure chambers via the check valve.

4. A valve timing control device according to claim 3, wherein a force-exerted face of the tier control member accommodated in the second release hydraulic pressure chamber to which the release hydraulic pressure is supplied via the check valve is a ring-shaped section defined at the end face of the rear major diameter section in the axial direction of the device.

5. A valve timing control device according to claim 3, wherein a force-exerted face of the tier control member accommodated in the first release hydraulic pressure chamber to which the release hydraulic pressure is supplied via the check valve is a circular section of the front minor diameter section.

6. A valve timing control device according to claim 1, wherein an area of a force-exerted face of the tier control member, which is subject to a hydraulic pressure of the advance side hydraulic pressure chamber is equal to or larger than an area of a force-exerted face of the tier control member, which is subject to a hydraulic pressure of the retardation side hydraulic pressure chamber.

7. A valve timing control device according to claim 1, further comprising a seal member arranged between the fitting hole and the retardation side hydraulic pressure chamber and creating a seal to block flow of actuating oil between the advance and retardation side hydraulic pressure chambers.

8. A valve timing control device according to claim 1, wherein the fitting hole is disposed at an approximately intermediate position apart from any of the maximum advanced side position and the maximum retarded side position, and wherein a seal member is arranged between the fitting hole and the retardation side hydraulic pressure chamber and creating a seal to block flow of actuating oil between the advance and retardation side hydraulic pressure chambers.

* * * * *